US010329758B2

(12) United States Patent
Margalit

(10) Patent No.: US 10,329,758 B2
(45) Date of Patent: Jun. 25, 2019

(54) WATER DRAINING SPANDREL ASSEMBLY AND INSULATED PANEL WINDOW WALLS

(71) Applicant: AYO-AP CORPORATION, Lawrence, NY (US)

(72) Inventor: Yonatan Z. Margalit, Lawrence, NY (US)

(73) Assignee: AYO-AP CORPORATION, Lawrence, NY (US)

( * ) Notice: Subject to any disclaimer, the term of this patent is extended or adjusted under 35 U.S.C. 154(b) by 0 days.

(21) Appl. No.: 15/961,856

(22) Filed: Apr. 24, 2018

(65) Prior Publication Data

US 2018/0305921 A1 Oct. 25, 2018

Related U.S. Application Data

(60) Provisional application No. 62/489,363, filed on Apr. 24, 2017.

(51) Int. Cl.
*E04B 1/70* (2006.01)
*E06B 1/70* (2006.01)
(Continued)

(52) U.S. Cl.
CPC ..... *E04B 1/7038* (2013.01); *E04B 2/90* (2013.01); *E06B 1/702* (2013.01); *E06B 7/14* (2013.01);
(Continued)

(58) Field of Classification Search
CPC .... E04B 1/7038; E04B 1/7046; E04B 1/7053; E04B 1/7076; E04B 1/7069; E04B 2/42;
(Continued)

(56) References Cited

U.S. PATENT DOCUMENTS 3,450,427 A * 6/1969 Fischer ..... E04F 13/0855 403/256
4,052,831 A * 10/1977 Roberts ..... E04F 13/0844 52/309.8
(Continued)

FOREIGN PATENT DOCUMENTS

DE 10 2010 005 571 4/2011
DE 20 2010 004 020 9/2011
(Continued)

OTHER PUBLICATIONS

Screenshots from Kingspan Karrier Panel video (published Jan. 30, 2016 on https://youtu.be/IAlIBWginOU).
(Continued)

*Primary Examiner* — Kyle J. Walraed-Sullivan
(74) *Attorney, Agent, or Firm* — Pearl Cohen Zedek Latzer Baratz LLP

(57) ABSTRACT

A window wall assembly including an insulated panel having at least one hole; at least one spacer located between and abutting a first portion of an outside of the insulated panel and an inside of an architectural fascia panel; at least one layer of nonconducting material connected to the at least one spacer and sandwiched between a second portion of the outside of the insulated panel and the inside of the architectural fascia panel; and a first fastener having a hollow inner section inserted into the at least one hole which has threading on the inside, an outer section having threading on the outside and extending into the layer of nonconducting material; and a flange located between the inner section and outer section of the first fastener and having a greater lateral dimension than the radius of the at least one hole.

24 Claims, 22 Drawing Sheets

(51) Int. Cl.
*E04B 2/90* (2006.01)
*E06B 7/14* (2006.01)
*E04B 2/42* (2006.01)

(52) U.S. Cl.
CPC ..... *E04B 2/42* (2013.01); *E06B 2001/707* (2013.01); *E06B 2007/145* (2013.01)

(58) Field of Classification Search
CPC ..... E04B 2/44; E04B 2/96; E04B 2/90; E04B 2/885; E04B 2/92; E04B 9/30; E04B 9/127; E04B 9/26; E04B 9/16; E06B 1/702; E06B 1/70; E06B 2/88; E06B 2/90; E06B 2/92; E06B 2001/707; E06B 3/54; E06B 3/5409; E06B 3/5427; E06B 3/5454; E06B 2003/6241; E06B 7/14; E06B 2007/145
USPC ..... 52/302.1, 302.3, 209, 506.06, 509, 235
See application file for complete search history.

(56) References Cited

U.S. PATENT DOCUMENTS 4,096,678 A 6/1978 Diels et al.
4,123,885 A 11/1978 Scott
4,267,679 A 5/1981 Thompson
4,283,897 A 8/1981 Thompson
4,304,083 A 12/1981 Anderson
4,316,351 A 2/1982 Ting
4,387,542 A * 6/1983 Wehr ..... E06B 1/32 52/204.591
4,400,922 A 8/1983 Boyer
4,514,945 A 5/1985 Menchetti et al.
4,581,868 A 4/1986 McCann
4,638,613 A 1/1987 Tonsmann
4,691,487 A 9/1987 Kessler
4,741,141 A * 5/1988 Harke ..... E04F 13/0857 411/82
4,819,405 A * 4/1989 Jackson ..... E04C 2/523 52/171.3
5,239,798 A * 8/1993 Saito ..... E04B 2/92 52/235
5,510,575 A 4/1996 Weibler
5,749,282 A 5/1998 Brow
6,968,659 B2 11/2005 Boyer
7,007,433 B2 3/2006 Boyer
7,748,181 B1 7/2010 Guinn
2004/0003553 A1* 1/2004 Donoghue ..... E06B 1/325 52/204.5
2006/0075702 A1 4/2006 Billings
2006/0123723 A1* 6/2006 Weir ..... B32B 5/245 52/302.1
2008/0245016 A1* 10/2008 Culyer ..... E04B 1/7069 52/506.01
2009/0049782 A1* 2/2009 Long, Sr. ..... E04B 1/4171 52/506.05
2009/0193756 A1 8/2009 Kant et al.
2010/0192495 A1* 8/2010 Huff ..... E04F 13/0846 52/302.1
2010/0251648 A1* 10/2010 Wilson ..... E04F 13/0864 52/302.1
2012/0214397 A1 8/2012 Strycharske et al.
2012/0279153 A1* 11/2012 Keene ..... E04B 1/7046 52/302.1
2013/0269276 A1* 10/2013 Gaynor ..... E04F 13/083 52/506.05
2014/0115988 A1* 5/2014 Sievers ..... E04B 1/10 52/302.1
2014/0115989 A1* 5/2014 Sievers ..... E04C 2/386 52/302.1
2014/0260011 A1 9/2014 Pettibone
2015/0059260 A1* 3/2015 Kallweit ..... E04F 13/007 52/99
2015/0204063 A1* 7/2015 Poulakis ..... A44B 18/0073 52/309.4
2015/0300004 A1* 10/2015 Ter-Borch ..... E04F 13/0803 52/506.05
2016/0326739 A1* 11/2016 Martel ..... E04B 1/7069
2017/0030072 A1* 2/2017 Corson ..... E04B 1/665
2017/0152700 A1* 6/2017 Franck ..... E06B 3/025
2018/0112394 A1* 4/2018 Giles ..... E04B 1/7629

FOREIGN PATENT DOCUMENTS

GB 2 167 110 5/1986
WO WO 2010/068655 6/2010

OTHER PUBLICATIONS

International Search Report from International Patent Application No. PCT/US18/29237, dated Oct. 24, 2018.

* cited by examiner

WATER DRAINING SPANDREL ASSEMBLY AND INSULATED PANEL WINDOW WALLS

CROSS-REFERENCE TO RELATED APPLICATIONS

This application claims the benefit of U.S. Provisional Patent Application No. 62/489,363, filed Apr. 24, 2017, which is incorporated herein by reference.

FIELD OF THE INVENTION

The present invention relates to exterior building envelope enclosures and, more particularly, to a water draining spandrel assembly with a design optimized for an improved architectural window wall which includes an insulated panel joined to an architectural fascia and dry side structural reinforcement as needed.

BACKGROUND OF THE INVENTION

It is known in the construction of large, high-rise commercial or residential buildings to construct a self-supporting structure of a roof, floors and interior bearing members out of concrete and/or steel, and to clad this self-supporting structure with an exterior building envelope enclosure.

Common types of exterior building envelope enclosures known in the art are shown in FIGS. 1A-1D. FIG. 1A is a vertical cross-sectional view of a standard window wall. FIG. 1B is a vertical cross-sectional view of a standard curtainwall. FIGS. 1C and 1D are vertical cross-sectional views of hybrid window/curtain wall systems, which are window walls designed to incorporate curtainwall aesthetics and certain design principles.

These exterior building envelope enclosures typically have simple metal vertical wall structures 10 which are joined to horizontal floor structures (not shown) to create modules. On site, modules vertically and horizontally join and or align to each other with verticals 10 and horizontals (not shown) which incorporate male/female joinery as well as vertical seals.

Architectural fascia materials such as glass 15 can be used at vision and opaque areas, and are typically glazed in the factory but can be site glazed as well.

FIG. 1A shows a typical, window wall assembly, with verticals 10 and horizontals (not shown), which is factory assembled and then site installed between two adjacent concrete floor slabs 16 and sealed with caulking 18 and 18', respectively, with sub sill receptors 14 and head receptors 12.

During assembly, after the window wall assembly is placed into the sub sill receiver 14, its upper end is then rotated forward into the head receptor extrusion 12. The window wall assembly is prevented from leaning outward by an exterior extruded arm in the head receptor. The extruded arm of the head receptor 12 usually contains seals that make contact with the horizontal top edge of the window wall assembly. The window wall assembly can then be joined to a previously-installed window wall assembly by using male/female vertical 10 with vertical seals. A separate drive-on extrusion may then be driven into the interior side of the head receptor extrusion 12 and locked into place, for example by way of serrated teeth and leverage, while holding the window wall assembly tightly into the head receptor 12. Sealant (not shown) may be applied to critical areas in order to ensure a tight air and water seals.

Typical window wall assemblies, such as the typical window wall assembly shown in FIG. 1A, often require a waterproof membrane which seals the concrete slabs 16. This waterproof membrane is then covered with an insulated external spandrel cover panel 20 to cover the concrete slab 16. The membrane is required since, over time, exterior surface applied seals become compromised, and water is expected to enter through spandrel cover panel 20 and can cause damage to concrete slab 16 over time and simply leak to the interior.

Window wall assemblies as shown in FIG. 1D have a notched vertical bottom and often require a time- and sequence-critical site-installed waterproof membrane. The surface receiving the waterproof membrane must be clear of debris, sufficiently dry, primed and generally prepared, so that the membrane bonds properly to the concrete slab 16 as well as to the module previously installed below. The membrane is required since water is expected to enter through vertical 10 of multiple modules installed on any given floor and is viewed as a design limitation which must be overcome by adding the site-installed waterproof membrane.

With typical window wall assemblies, as shown in FIGS. 1A, when loads, such as wind pressure, are applied to window wall assemblies, water will likely enter the various joinery of vertical and horizontals and the locations where discreet modules vertically join to each other with male/female verticals 10 and vertical seals. This water collects into a sub sill 14 which acts to collect water from multiple modules installed on any given floor.

One problem with typical window walls and their sub sills, such as sub sill 14, is that, depending on wind pressure and volume of water collected, the sub sill may need varying vertical heights in order to properly manage drainage of collected water. This requires various sub sill designs so as to manage different conditions on a given project or the design team will be forced to use the highest performing sub sill so that aesthetics remain constant. However, requiring different sub sill designs on a single project complicates the design of each project and increases inventory requirements, lab testing with various sub sill designs. Often projects default to the highest performing sub sill required on a given project in order to simplify the process even if it compromises optimal aesthetics and thermal performance.

Sub sills with modest vertical heights will not drain collected water as well as those with increased vertical heights. This is because the increase in vertical height presents additional surface area and, therefore, an area for increased thermal exchange. Thermal exchange impacts interior surface temperature conditions of typical sub sills, such that, in cold climates, as the height of the sub sill is increased, the risk of interior water vapor condensing on its interior surfaces, which is an unwanted condition, is also increased. In warm climates, a large sub sill increases interior surface temperature and can result in condensation forming on exterior surfaces, as well as extreme interior hot surfaces, which are unwanted conditions.

Curtain walls, such as in FIG. 1B, and window walls, such as FIGS. 1C and 1D, utilize at least one continuous metal vertical 10 which is connected to horizontals (not shown). The continuous metal vertical design approach increases thermal exchange between architectural shadow box areas, which are often pressure equalized and conditioned to the exterior environment, and framing at vision areas, which are conditioned to the interior environment. This design approach impacts conditions within the shadow box and can present as visual distortions, which is an unwanted condition. This design approach impacts interior surface conditions of vertical 10 and the horizontal (not shown) which acts as a transition between the shadow box and the vision area. In cold climates, it increases the risk of interior water vapor condensing on the interior surfaces of the vision area as entering through small flaws in frame seals and condensing on the interior surfaces of the shadow box, which are unwanted conditions. In warm climates, the continuous vertical increases the interior surface temperature, can promote condensation forming on exterior surfaces and can promote condensation forming on multiple surface areas within the shadow box, which is an unwanted condition.

The rain screen design approach is principally used to protect all types of primary air seals from direct exposure to exterior conditions, such as direct exposure to the sun, water and contaminates deposited by rain and wind, by locating them in a hidden area beyond the outermost exposed exterior surface of exterior building envelope enclosures.

The rain screen approach is viewed as an advanced design approach. Previously, curtainwalls and window walls as depicted in FIGS. 1A-D used an exterior primary weather seal, which was placed on the outermost envelopes surface, and was often referred to as "fish tanking". These seals placed on the outermost envelopes surface were directly exposed to various weather conditions, including UV from the sun light, and, therefore, required regular maintenance. Today's curtain walls, such as shown in FIG. 1B, and window walls, such as shown FIGS. 1C and 1D, utilize the rain screen design approach to protect the primary vertical and horizontal air seal barriers located behind an exterior face of the vertical and horizontal framing. The primary vertical air seal is site-married to primary horizontal seals with silicone.

The rain screen design approach presents a challenge since often it is difficult to measure the amount of moisture, or other surface contaminant, which may be present on the surfaces of materials to be joined and which can limit optimal adhesion of silicone to substrate surfaces. The silicone often joins to vertical and horizontal frame surfaces which move independent of each other due to thermal cycling, wind, seismic and live loads and for which the joinery and seals are not optimally designed, and these conditions can cause these critical air seals to become compromised.

Another problem with the rain screen approach is that, when structural aluminum framing is being used, the seals' optimal location for thermal control would be on the outermost exterior surface. With the rain screen approach, optimal thermal conditions are not being realized. In cold climates, this increases the risk of condensation collecting on the interior of the building, and in warm climates, this can promote extreme interior surface temperatures and condensation forming on exterior surfaces, which are unwanted conditions.

Thermal problems associated with rain screen designs are viewed as a design limitation which must be overcome by adding exterior factory-extruded compression seals or by increasing the interior aluminum mass. However, adding exterior compression seals requires long term maintenance. In addition, adding aluminum is costly and can create extreme hot spots on the systems' interior surfaces when cold weather transitions to hot weather.

As described, curtain walls such as in FIG. 1B and window walls such as FIGS. 1C and 1D utilize a continuous metal vertical 10 which are connected to horizontals (not shown). The continuous metal vertical design approach increases the chance that sound and heat will travel vertically from one floor to another, an unwanted condition. In order to manage sound traveling, a design limitation, the verticals are often filled with different materials to reduce sound traveling. Often condensation collects in these areas, and creates a risk of mold growth, an unwanted condition.

Curtain walls such as in FIG. 1B and window walls such as FIG. 1C and FIG. 1D utilize a continuous metal vertical 10 which are connected to horizontals (not shown). The continuous metal vertical design approach also increases the chances that sound and/or heat and smoke generated from a fire can travel through the continuous vertical, to floors generally above the sound and fire source, which create life, safety and health issues, can cause other building materials to combust or otherwise be damaged, and can compromise the structural integrity of the vertical which can compromise the vertical's structural connection to the slab 16, all of which are unwanted conditions.

Interior water vapor condensing on visible surfaces is a problem known to many, and design solutions have been substantially resolved and continue to be improved as means, methods and advanced materials prove out and become commercially viable.

Interior water vapor condensing in hidden areas or directly adjacent to hidden areas is a problem that has not received as much attention. These areas are often now being referred to as "outside the mechanical boundary condition" because mechanical engineers cannot easily design a heating system to value this space. Managing this area is left to the designers, façade engineers, assemblers and installers of the exterior building envelope enclosure. The use of internal thermal enhancing materials often referred to as insulation has been used in North America for many decades. These materials, when placed in cavities between the finished space and the exterior wall, or outside the mechanical boundary condition, increase the surface temperature of materials such as finished opaque sheetrock walls. These thermal enhancing materials also have been and continue to be used to reduce outdoor to indoor noise transmission. These materials, however, could have a very detrimental impact on a first condensing surface of exterior building envelope enclosures, such as those depicted in FIGS. 1A-1D. As one adds insulation to cavities between the finished space and the exterior wall, the less conditioned heated air can be absorbed by the first surface to condense.

A global problem with all the conventional exterior building envelope enclosures, such as those depicted in FIGS. 1A-1D, is that they are assembled using structural metal vertical and horizontal framing. Thermal exchange impacts interior surface conditions of structural metal framing at both vision and opaque areas. Opaque or hidden areas present a more profound problem since they are typically outside the mechanical boundary and are encased by finished assemblies, comprised of vertical metal stud and sheetrock. These encased finished assemblies create discrete vertical chambers wherein air is substantially trapped or limited in its ability to promote sufficient convection of tempered air which passes through the sheetrock and to allow any collected water to simply evaporate over time. The interior plane and other tubular surfaces of the structural metal vertical and horizontal framing of the curtainwall and/or window walls are defined as the first surface to condense. In cold climates, structural metal framing increases the risk of interior water vapor condensing on these surfaces, which is an unwanted condition. In warm climates the interior surface temperature increases as a result of the structural metal framing, and cooling systems can promote condensation forming on exterior surfaces, which is an unwanted condition.

A global problem with the sequence of field installation is that site conditions may be optimal for installation of window wall or curtain wall modules but not optimal for application of sealants used to marry vertical and horizontal primary air seals. Often it is difficult to measure the amount of moisture or other surface contaminant which may be present on the surfaces of materials to be joined and which can limit optimal adhesion of silicone to substrate surfaces. Regardless, installation often proceeds, and best efforts are employed by persons skilled and experienced. However, after the installation is completed, checking that all these hidden seals have been optimally applied and have cured properly requires field testing at each location, since they are hidden from view. This is a cost-prohibitive exercise, and, therefore, only random field testing is usually employed. Visual inspection of all critical primary air seals is certainly a preferred path but is not often viable with certain system designs.

FIG. 1E shows conventional metal vertical framing 10. Vertical framing 10 may include a vertical air seal 50 where a site-installed marriage bead is located. Architectural fascia 55 can be attached to the vertical framing 10. FIG. 1F shows conventional metal horizontal framing 65. The horizontal framing 65 may include a horizontal air seal 60 where a site-installed marriage bead is located. Architectural fascia 55 can be attached to the horizontal framing 65.

Repairing or replacing a compromised primary air seal barrier, such as those depicted in FIGS. 1E and 1F, is complicated due to its hidden nature, and often the only corrective measure is to place a seal on the interior surface or access the exterior surfaces of the exterior building envelope enclosure and apply a face seal. Both methods are not preferred remedies and result in unwanted conditions.

Window wall systems which use non-structural insulated panels to enclose a building are typically fastened, from the exterior, to at least one interior vertical structural metal stud. Accessing this fastening location from the exterior is time consuming, increases insurance exposures, is impacted by weather, and requires specialized equipment to access it with either pipe scaffolding, man lifts and hanging scaffolds. Furthermore, insulation connected to a metal layer, or sandwiched between two metal layers, can be damaged when site drilling through the insulated panel. Fastening from the exterior requires multiple steps and are typically as follows. Step 1—Pre-drill an oversized access hole in the insulated panel. Step 2—Place a self-drilling fastener into the access hole. Step 3—Drill fastener and thread the interior vertical metal reinforcement. Step 4—Place leveling shims. Step 5—Properly torque the fastener to join the insulated panel to the interior vertical metal reinforcement. The requirement for multiple steps complicates the process and requires multiple tools, drill bits and careful attention. Additionally, the next panel cannot be installed until these steps are completed, and this, therefore, presents the risk of slowing down the process. Also, for example, when typical fasteners are tightened, the outer metal layer of the insulated panel can be displaced radially inward, such that the insulation can yield and the insulated panel can be compromised, which are unwanted conditions.

Accordingly, there is a need for a spandrel assembly which incorporates an architectural fascia, such as glass, head receptors and sub-sills with a modest vertical height and other built-in design methods to promote water drainage and drying of drainage path in all weather conditions, and pre-installed fasteners.

Accordingly, there is a need for a window wall assembly with architectural fascia such as glass and without structural metal vertical and horizontal frame parts.

Accordingly, there is a need for a window wall assembly with primary air seals placed on the interior, and sealed so they will not substantially impact the thermal properties, wherein the primary air seals can be installed when the exterior building envelope enclosure is substantially completed and interior conditions are optimal for cleaning and preparing surfaces which will receive primary seals. This allows for visual inspection of all primary air seals, along with random field testing by an independent laboratory as may be required.

Accordingly, there is a need to provide an exterior building envelope enclosure that allows for optimal indoor air quality. With optimal relative humidity levels being a large component of indoor air quality, the elimination of metal vertical and horizontal framing from window walls reduces risk. Optimal indoor air quality with optimal relative humidity levels must be achieved without increasing risk of water vapor condensing on interior surfaces of the exterior building envelope enclosure and introducing great risks associated with mold growth.

SUMMARY OF THE INVENTION

It is an object of the present invention to provide a spandrel assembly that can collect water that has entered from an outside of a building and can channel the collected water back to the outside of the building.

It is also an object of the present invention to reduce the height of the walls of a sub sill necessary to reduce risk of condensation occurring on interior surfaces, in order to ensure that a bottom of a primary window wall does not make contact with water collected in the sub sill and that the sub sill manages drainage of water and drying of the drainage path, as required.

It is also an object of the invention to provide a spandrel architectural fascia which can be applied with adhesive tape or silicone to a spandrel frame assembly and thereby protect the spandrel frame assembly from direct contact with the exterior environment, in both cold and warm climates, and decrease thermal transfer.

It is also an object of the present invention to provide a spandrel assembly architectural fascia which allows an approximately 1"+/− vertical gap. This gap allows the sub-sill to drain through an actuated scupper as well as through vertical wet downtubes.

It is also an object of the present invention to provide a spandrel assembly architectural fascia which allows an approximately 1"+/− vertical gap. This gap allows for an assembly which uses various methods to collect and concentrate wind air pressure and to promote drainage of the sub sill and enhance drying of wet downtube surfaces, thereby reducing risks associated with standing water and ice build-up.

It is also an object of the present invention to eliminate the need for needlessly complex and difficult-to-join-together vertical and horizontal metal framing at glass shadow box and other opaque window wall areas.

It is also an object of the present invention to introduce a sub-sill and head receptor which act to clasp insulated panels so that insulation material will remain adhesively joined to the outer and inner layers of the insulated panel assembly.

It is also an object of the present invention to create an architectural window wall with a substantial reduction in material components and assembly steps.

It is also an object of the present invention to create a structural-insulated panel by using structural silicone to join together a non-structural insulated panel to an exterior or interior located structural diaphragm. When the structural diaphragm, such as glass or other architectural fascia, is located as defined by the design team, on the exterior and or interior, an enhanced architectural window wall is realized.

It is also an object of the present invention to utilize a precise volume of structural silicone to join together a non-structural insulated panel to an exterior or interior located structural diaphragm so as to spread imposed loads such as wind pressure over an area sufficient to avoid compromising insulation material adhesive properties to the outer and inner layers of the insulated panel assembly It is also an object of the present invention to realize an additional free benefit from the enhanced architectural window wall described above. When joining the materials as described above, we have an assembly that has advanced acoustical properties, specifically those defined and measured by Outdoor to Indoor Transmission Class ("OITC").

It is also an object of the present invention to utilize existing, mature, plentiful, automated and semi-automated insulated glass assembly machines. The system assembly steps have been optimized so they do not substantially disrupt existing processing steps of the automated and or semi-automated insulated glass assembly machine. This creates all types of benefits to the advanced architectural window wall including quality of finished product, easier to predict scheduling, and a less complicated scalable business.

It is also an object of the present invention to eliminate the need to drill and fasten an insulated panel from the exterior to a variable dry side reinforcement.

It is also an object of the present invention to preload fastening points in areas protected by fire resistant structural silicone or other adhesive methods and to provide access to these fastening points from the interior, thereby eliminating the need to drill and fasten from the exterior and or interior.

It is also an object of the present invention to eliminate the need to install internal dry side vertical reinforcement of window wall in advance of the exterior building envelope enclosure being mounted to the buildings structure, since internal dry side vertical reinforcement gets in the way of interior installation.

It is also an object of the present invention to reduce the risk of interior condensation forming by optimizing air flow between typical mechanical boundary conditions such as sheetrock walls and the interior surface of the exterior building envelope enclosure.

According to some embodiments of the invention, there is provided a window wall assembly and a method of manufacturing the window wall assembly. The window wall assembly may include an insulated panel, an architectural fascia panel on the exterior and or interior of the insulated panel, and at least one spacer located between an outside of the insulated panel and an interior side of the architectural fascia panel. The at least one spacer may create a gap between the first sheet of the insulated panel and the architectural fascia panel. The window wall assembly may include a layer of nonconducting material within at least a portion of the gap between the first sheet of the insulated panel and the architectural fascia panel. The layer of nonconducting material may be adhesive. The layer of nonconducting material may include an adhesive configured to bond the first sheet of the insulated panel and the architectural fascia panel or may be attached by adhesive to the first sheet of the insulated panel and the architectural fascia panel.

The window wall assembly may include a first fastener. The architectural fascia panel may have structural diaphragm properties, such as a sheet of glass, steel, aluminum, or fiber glass reinforced concrete.

The insulated panel may include a layer of insulation sandwiched between a first sheet and a second sheet. The first sheet may be substantially parallel to the second sheet. The first and second sheets may be a first thin metal sheet and a second thin metal sheet. The layer of insulation may be adhered to the first and second sheets.

The insulated panel may have at least one hole extending through the insulated panel. The architectural fascia panel may be substantially parallel and proximal to the first sheet.

The first fastener may include an inner section inserted into the at least one hole, an outer section extending into the layer of nonconducting material, and a flange located between the inner and outer section of the first fastener. The inner section of the first fastener may be hollow and include threading on the inside. The outer section may include at least one radially projecting structure on an outside thereof.

The outer section may include threading on an outside of the outer section. The threading of the outer section can be used to assist in replacement of architectural fascia as well as added surface area for silicone to adhere to. The flange may have a greater lateral dimension than the radius of the at least one hole. The flange may be connected to the at least one layer of nonconducting material. The flange may abut the outside of the first sheet.

The window wall assembly may include a second fastener having a flange and a threaded rod. The flange of the second fastener may have a greater lateral dimension than the radius of the at least one hole. The flange of the second fastener may abut an outside of the second sheet. The threaded rod may be attached to the threading of the inner section of the first fastener. The threaded rod may extend through the at least one hole and out into an interior of a building in a direction away from the flange of the second fastener.

A section of the threaded rod extending into the interior of the building may be connected to a dry-side structural reinforcement. The dry-side structural reinforcement may be a metal stud. The dry-side structural reinforcement may run from a portion of a bottom surface of an upper concrete slab to a portion of the upper surface of a bottom concrete slab of the building. The dry-side structural reinforcement may have a plurality of holes that are perpendicular to the insulated panel which allow air to flow through the dry-side structural reinforcement in a direction substantially parallel to the insulated panel.

In some embodiments of the invention, the window wall assembly may include a head receptor extending in a lengthwise direction. The head receptor may include a top, an inner wall, and an outer wall forming an upside-down U shape or an upside-down trough-like shape. The head receptor may be connected to the upper floor slab. A top portion of the insulated panel extending above the architectural fascia panel may sit between the top, inner wall and the outer wall of the head receptor. The heights of the inner and outer walls of the head receptor may restrict a movement of the insulated panel in a direction transverse to the lengthwise direction. The window wall assembly may include at least one primary horizontal air seal located between a second portion of the outside of the second sheet and a portion of an inside of the inner wall of the head receptor.

In some embodiments of the invention, the window wall assembly may include a sub sill extending in a lengthwise direction. The sub sill may include a bottom, an inner wall, and an outer wall forming a U shape or a trough-like shape. The sub sill may be connected to the lower floor slab. A bottom portion of the insulated panel extending below the architectural fascia panel may sit between the bottom, inner wall and the outer wall of the sub sill. The heights of the inner and outer walls of the sub sill may restrict a movement of the insulated panel in a direction transverse to the lengthwise direction. The sub sill may have at least one slit hole, of opening to an outside of the building. In some embodiments of the invention, the sub sill's opening to the outside of the building may be a scupper which opens out to the outside of the building only when a weight of water collected in the sub sill is above a predetermined weight.

The window wall assembly may include at least one primary horizontal air seal located on and accessible from the interior dry-side of the building, and located between a first portion of an outside of the second sheet and a portion of an inside of the inner wall of the sub sill.

In some embodiments of the invention, the window wall assembly may include a lower starter track connected the lower floor slab. The lower starter track may extend along the direction substantially parallel to the lengthwise direction of the sub sill. The bottom of the sub sill may be connected to a first portion of a top surface of the lower starter track. A dry-side structural reinforcement may extend from a second portion of the top surface of the lower starter track.

The window wall assembly may include an upper starter track connected to the upper flow slab. The lower starter track may extend along the direction substantially parallel to the lengthwise direction of the head receptor. The top of the head receptor may be connected to a first portion of a bottom surface of the upper starter track. The dry-side structural reinforcement may extend from a second portion of the bottom surface of the upper starter track.

The insulated panel may be connected to the dry-side structural reinforcement, such that there is a height of space between the bottom of the insulated panel and the inner wall, the outer wall, and the bottom of the sub sill, such that water accumulating in the sub sill does not touch the bottom of the insulated panel.

In some embodiments of the invention, the window wall assembly includes at least one primary vertical air seal located on and accessible from the interior dry-side of the building, and located between the insulated panel and a second adjacent insulated panel.

In some embodiments of the invention, the window wall assembly includes a drain hole located in the bottom of the sub sill which is connected to a downtube. Water that may be collected in the sub sill can exit to the outside of the building via the drain hole and down tube.

In some embodiments of the invention, the window wall assembly includes an air channel having an air entrance located outside of the building; a water exit located outside of the building and below the air entrance; and a water entrance located below the air entrance and connected to the down tube. Water that may be collected in the sub sill can exit to the outside of the building through the water exit of the air channel. The air channel may have at least one of an air guide attached to the air entrance of the air channel to guide air from outside of the building into the air entrance; and an air deflector attached to the exit of the air channel angled to control the volume of outside air entering into the exit of the air channel.

BRIEF DESCRIPTION OF THE DRAWINGS

In order for the present invention to be better understood and for its practical applications to be appreciated, the following Figures are provided and referenced hereafter. It should be noted that the Figures are given as examples only and in no way limit the scope of the invention. Like components are denoted by like reference numerals.

Figure 1A:
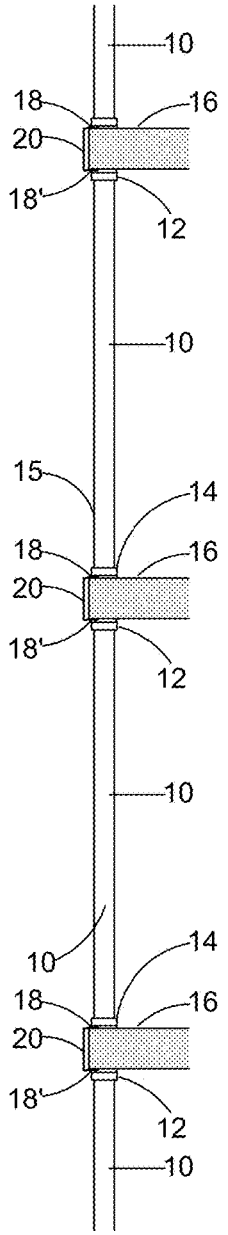
FIG. 1A PRIOR ART
FIG. 1A is a vertical cross-sectional view of a window wall system as known in the art.
Figure 1B:
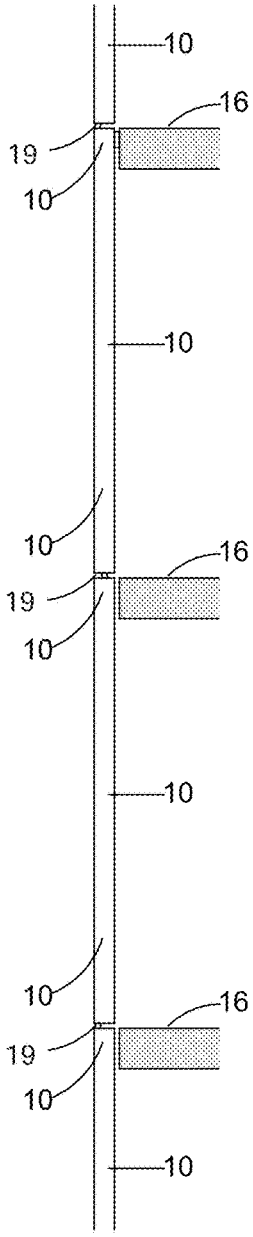
FIG. 1B PRIOR ART
FIG. 1B is a vertical cross-sectional view of a curtain wall system as known in the art.
Figure 1C:
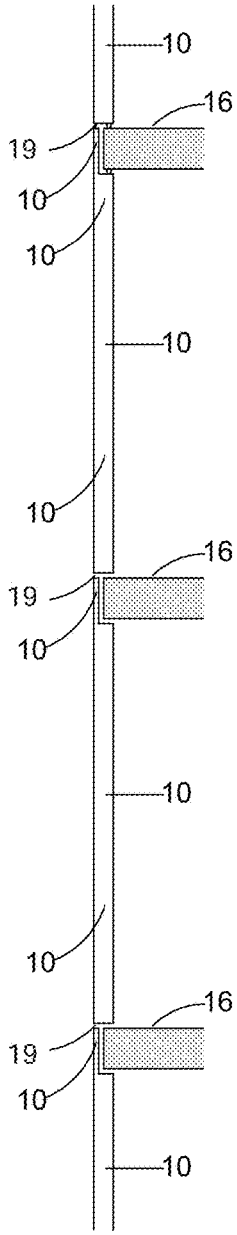
FIG. 1C PRIOR ART
FIGS. 1C and 1D are vertical cross-sectional views of hybrid window/curtain wall systems as known in the art.
Figure 1D:
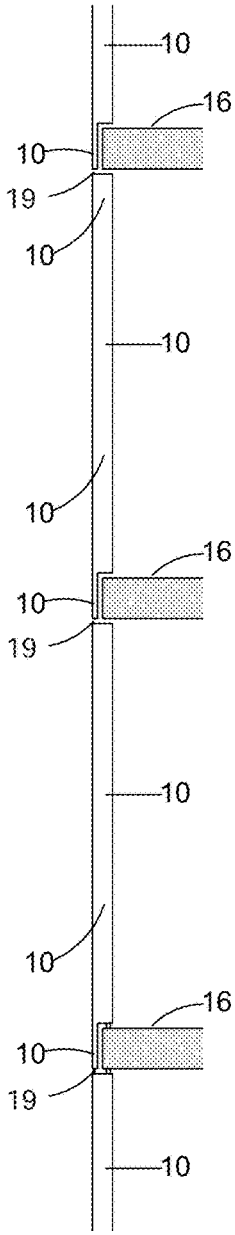
FIG. 1D PRIOR ART
Figure 1E:
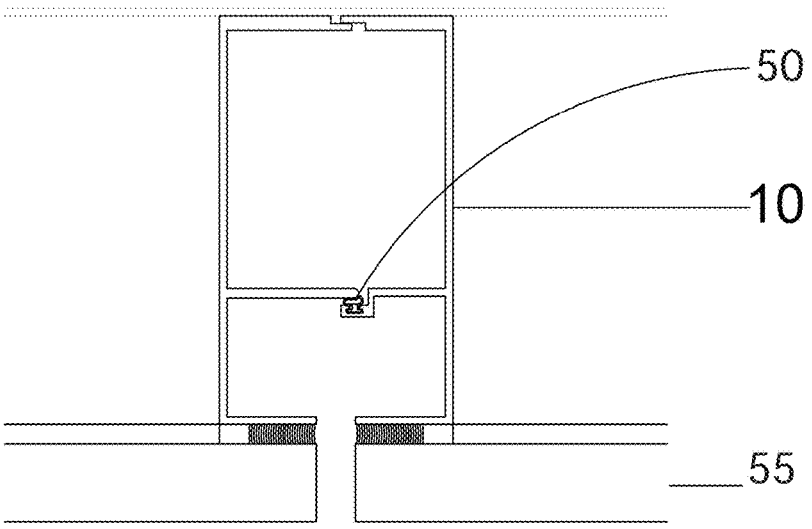
FIG.1 E PRIOR ART
FIG. 1E depicts conventional metal vertical framing used in buildings as known in the art.
Figure 1F:
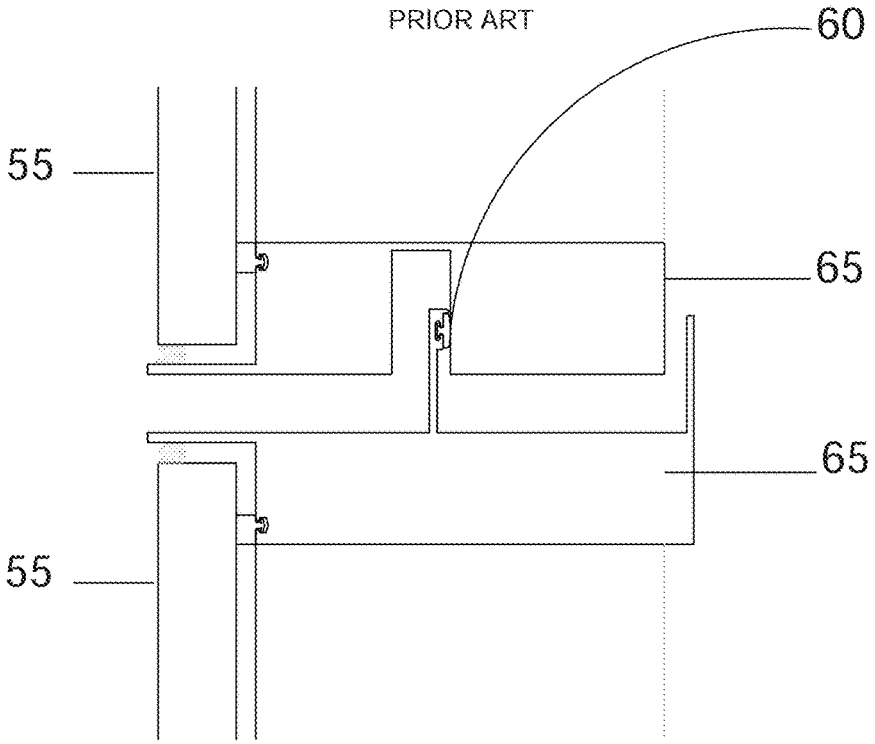
FIG.1 F PRIOR ART
FIG. 1F depicts conventional metal horizontal framing used in buildings as known in the art.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following description, various aspects of the present invention are described. For purposes of explanation, specific configurations and details are set forth in order to provide a thorough understanding of the present invention. However, it will be apparent to one skilled in the art that the present invention may be practiced without the specific details presented herein. Furthermore, well known features may be omitted or simplified in order not to obscure the present invention.

Figure 2A:
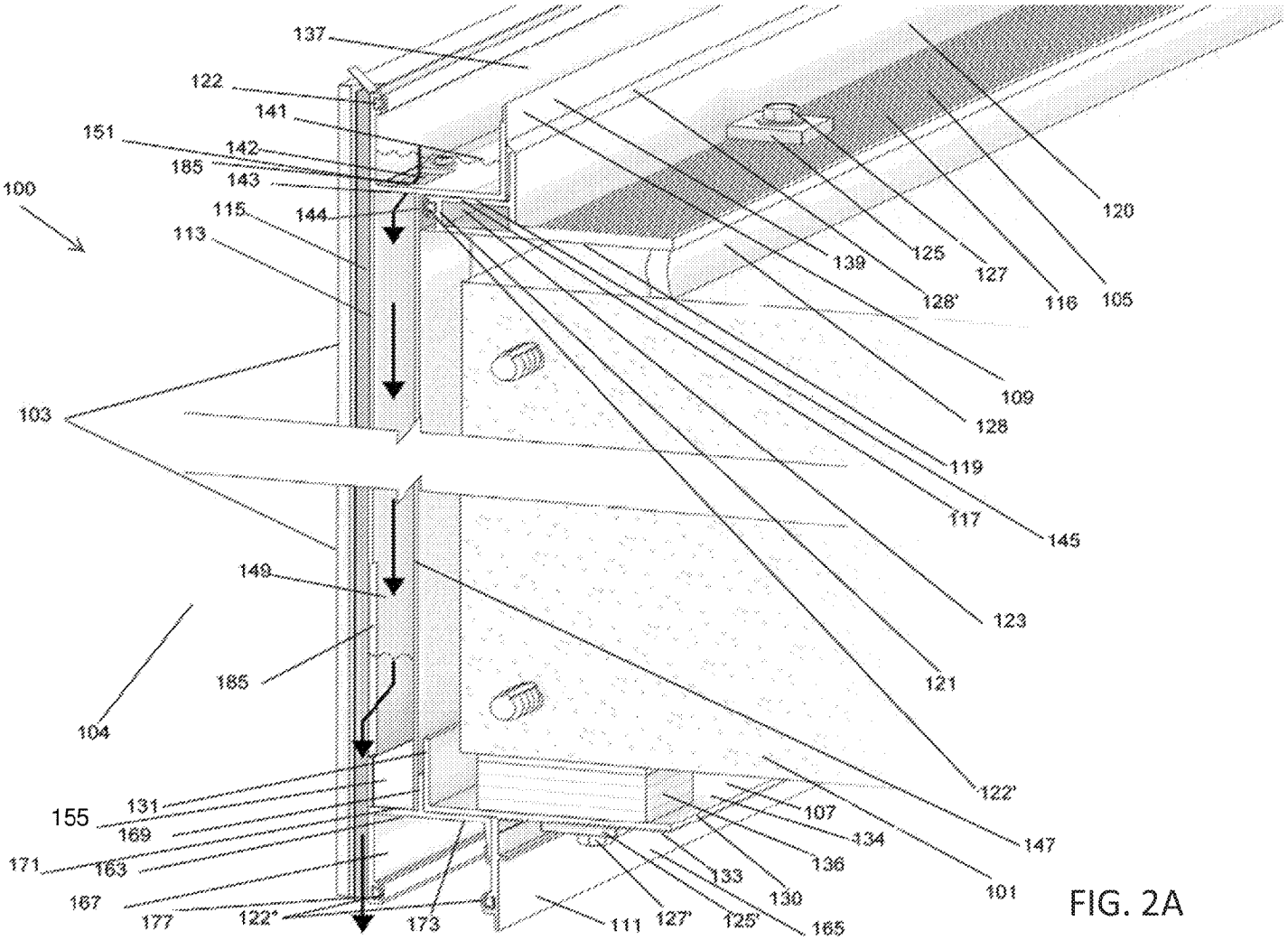
FIGS. 2A and 2B are a cutaway perspective views of a water draining spandrel assembly of a window wall system of a building, according to one embodiment of the invention.
Figure 2B:
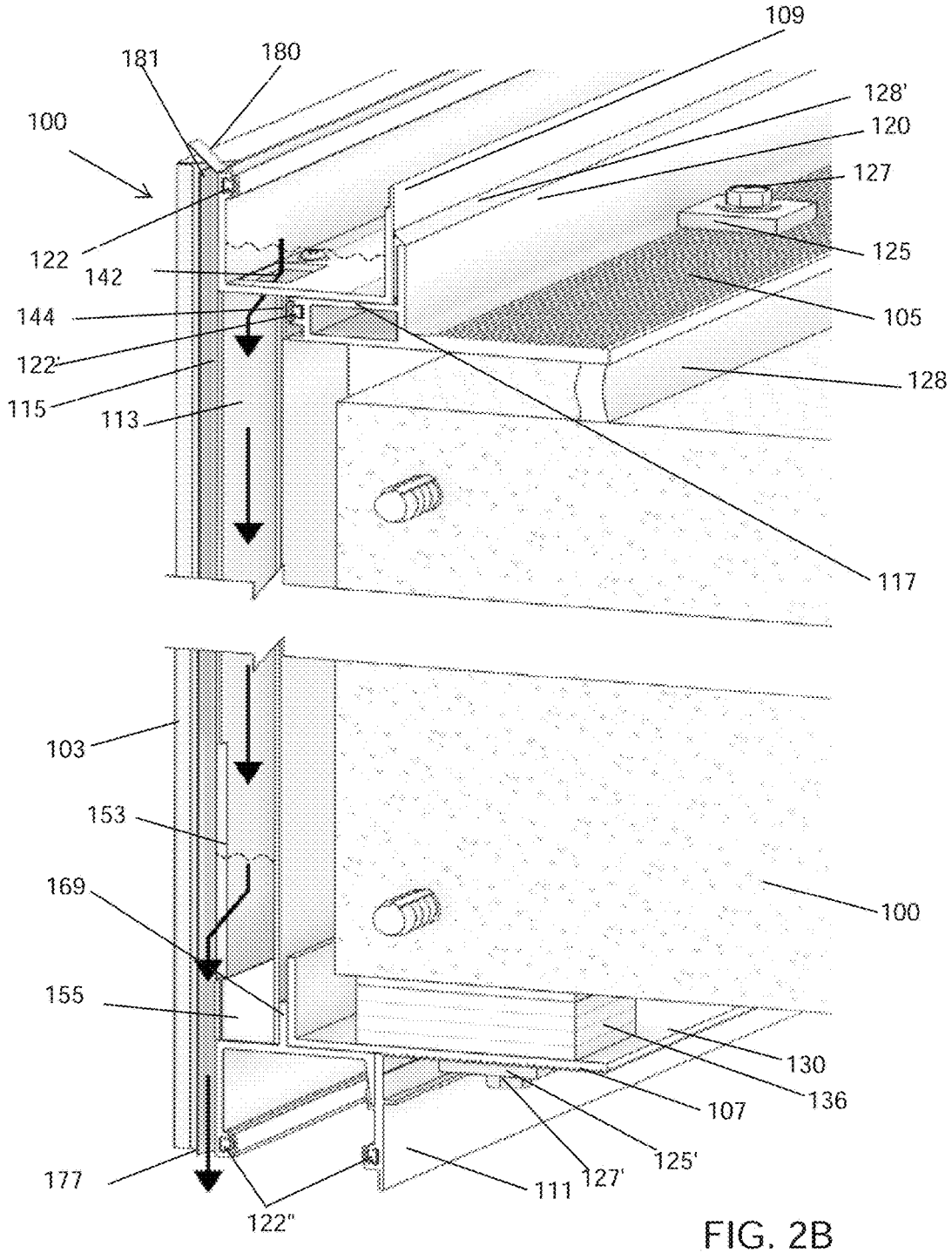

Reference is made to FIGS. 2A and 2B, which is are cutaway perspective views of a water draining spandrel assembly 100 of a window wall system of a building, according to one embodiment of the invention. The water draining spandrel assembly 100 can collect water which has entered from the outside of the building and can channel the collected water back to outside of the building.

As shown in FIGS. 2A and 2B, the water draining spandrel assembly 100 can be attached to an edge of the floor slab 101 of the building to cover the edge of the floor slab 101. The floor slab 101 can be made from concrete, steel, any other suitable material, or any combination thereof.

The spandrel assembly 100 can include an upper starter track 105, a lower starter track 107, a sub sill or sill receptor 109, a head receptor 111, a down tube 113, an air channel 115, and an exterior spandrel panel unit 103.

The upper starter track 105 can be a lengthwise metal extrusion such as a steel extrusion, with a back top surface 116, a front top surface 117, a bottom surface 119, a vertical guide leg 120, a front wall 121, and a lengthwise hollow area 123.

The upper starter track 105 can be attached to the floor slab 101 by inserting at least one anchor 127 downward through the back top surface 116 and bottom surface 119 of the upper starter track 105, and into an upper surface of the floor slab 101. The bottom surface 119 of the upper starter track 105 can be parallel to a top surface of the floor slab 101. The at least one anchor 127 can be inserted through a washer 125. The back top surface 116 of the upper starter track 105 can have a serrated surface, and a bottom of the washer 125 can have a serrated surface, both in order to aid in attaching the upper starter track 105 to the floor slab 101.

A width (i.e., the front-to-back distance) of the bottom surface 119 of the upper starter track 105 and/or a height between the bottom surface 119 and back top surface 116 of the upper starter track 105 are large enough so that the upper starter track 105 can resist bending towards or away from the outside of the building. A width of the back top surface 116 of the upper starter track 105 allows the anchors of the upper starter track 105 to be attached to an upper surface of the floor slab 101 which is interior to the edge of the floor slab 101. The farther interior the anchor is affixed from the edge of the floor slab 101, the more structural integrity there is between the upper starter track 105 and the floor slab 101. Additionally, the farther interior the anchor is affixed from the edge of the floor slab 101, the fewer anchors will be needed to secure the starter track 105 to the floor slab 101.

In some embodiments of the invention, at least one shim (not shown) can be located between the bottom surface 119 of the upper starter track 105 and an upper surface of the floor slab 101, which shim can be compressed when the upper starter track 105 is attached to the floor slab 101. Sealant 128 can be applied along the lengthwise direction of the upper starter track 105 between a bottom edge of the bottom surface 119 of the upper starter track 105 and the upper surface of the floor slab 101, so as to provide an air, water, fire, and smoke seal between floors of the building. The sealant 128 can be silicone, such as DOW 795, or any other suitable seal material that is known in the art.

The vertical guide leg 120 of the upper starter track 105 can be located between the back 116 and front 117 top surfaces of the upper starter track 105 and can extend in an upward direction away from back 116 and front 117 top surfaces of the upper starter track 105 along the lengthwise direction of the upper starter track 105. In some embodiments of the invention, the vertical guide leg 120 can be perpendicular to the bottom surface 119 of the upper starter track 105.

The front wall 121 of the upper starter track 105 can extend in an upward direction between an end of the front top surface 117 and an end of the bottom surface 119 of the upper starter track 105. The front wall 121 can be perpendicular to the bottom surface 119 of the upper starter track 105.

The lengthwise hollow area 123 can be located between the front top surface 117, a section of the vertical guide leg 120, a section of the bottom surface 119, and the front wall 121 of the upper starter track 105. The lengthwise hollow area 123 can be used to connect the upper starter track 105 to an adjoining upper starter track by, for example, inserting a connector (not shown) partly through the lengthwise hollow area 123 of upper starter track 105 and partly through the lengthwise hollow area 123 of the adjoining upper starter track. The lengthwise hollow area 123 can also manage potential water migration through any mechanical fasteners that are attached through the sub sill 109 and into the front top surface 117 of the upper starter track 105, by trapping the water therein until it evaporates.

The sub sill 109 can be mechanically connected or welded to the upper starter track 105. The sub sill can be a lengthwise metal extrusion, such as a steel extrusion. The sub sill 109 can have a front wall 137, a back wall 139, a bottom wall 141, which together form a U or trough-like shape for collecting water that has entered from an outside of the building. The sub sill 109 can be configured to accept and hold a bottom of a primary window wall substrate (not shown) between the front wall 137 and back wall 139 of the sub sill 109. The primary window wall substrate can be the insulated panel described in FIGS. 10A-E, as described hereinbelow. The shape of the sub sill 109 can contain a micro climate and force the dew point away from interior surfaces of the sub sill 109 in order to reduce the risk of ice-dams. The front wall 137 and back wall 139 of the sub sill 109 can brace the ends of insulated panel, and may have a vertical height necessary to achieve a water head or weight that is able to oppose the exterior winds and drain from the sub-sill through a weep slot or hole. Without there being a proper drain design, water will enter into the dry side or interior of the enclosed building.

The front wall 137 and the back wall 139 of the sub sill 109 can be parallel to the vertical guide leg 120 of the upper starter track 105. In some embodiments of the invention, the front wall 137 and the back wall 139 of the sub sill 109 may be perpendicular to the bottom 141 of the sub sill 109.

The back wall 139 of the sub sill 109 can abut a front surface of the vertical guide leg 120 of the upper starter track 105. Sealant 128' can be applied between the back wall 139 of the sub sill 109 and the vertical guide leg 120 of the upper starter track 105 so as to create an air and water seal. The sealant 128' can be silicone, such as DOW 795, or any other suitable seal material that is known in the art.

The front wall 137 of the sub sill 109 can have a rubber gasket 122 which can provide a water and air seal when the primary window wall substrate is held in the sub sill 109. The rubber gasket 122 can extend along an upper inside portion of the front wall 137 of the sub sill 109 in the lengthwise direction of the sub sill 109.

The bottom wall 141 of the sub sill 109 can be parallel to the front top surface 117 of the upper starter track 105. The bottom wall 141 of the sub sill 109 can have at least one opening 142 for channeling water collected in the sub sill 109 to a corresponding down tube 113. Each of the at least one opening 142 may be located above the corresponding down tube 113. The down tube 113 can have a hollow inside which is able to hold a sufficient weight of water to counteract against any air pressure exerted into the exit of the down tube 113.

In some embodiments of the invention, the sub sill 109 can include a vertical guide leg 144 extending downward from a bottom surface of the bottom wall 141 of the sub sill 109 along the lengthwise direction of the sub sill 109. The vertical guide leg 144 of the sub sill 109 can be parallel to the front wall 137 and back wall 139 of the sub sill 109. The vertical guide leg 144 of the sub sill 109 can be parallel to and abut the front wall 121 of the upper starter track 105. In some embodiments of the invention, the vertical guide leg 144 is perpendicular to the bottom wall 141 of the sub sill 109. A rubber gasket 122 can be located between vertical guide leg 144 of the sub sill 109 and the front wall 121 of the upper starter track 105 along a lengthwise direction of the sub sill 109 in order to provide an air and water seal.

The vertical guide leg 144 of the sub sill 109 can divide a bottom surface of the bottom wall 141 of the sub sill 109 into a front bottom surface 143 and a back bottom surface 145. The back bottom surface 145 of the sub sill 109 can be mechanically attached or welded to the front top surface 117 of the upper starter track 105. The front bottom surface 143 of the sub sill 109 can be mechanically attached or welded to the down tube 113.

The lower starter track 107 can be a lengthwise metal extrusion such as a steel extrusion, with a base 130 and a vertical guide leg 131. The base 130 and the vertical guide leg 131 of the lower starter track 107 can be perpendicular. The base 130 and vertical guide leg 131 can form an upper case "L" shape.

The lower starter track 107 can be attached to the floor slab 101 by inserting at least one anchor 127' upward through a bottom surface 133 and a top surface 134 of the base 130 of the lower starter track 107 and into a bottom surface of the floor slab 101. The top surface 134 of the base 130 can be parallel to the bottom surface of the floor slab 101. The at least one anchor 127' can be inserted through a washer 125' that can be placed around a part of the anchor extending below the top surface 134 of the base 130, and a stud header 127' can be attached to a part of the anchor extending below the washer 125'. The base 130 of the lower starter track 107 can have a serrated surface located on a back part of the bottom surface 133, and a top of the washer 125' can have a serrated surface, both to provide greater frictional force in order to aid in attaching the lower starter track 107 to the floor slab 101.

A width (i.e., the front-to-back distance) of the base 130 of the lower starter track 107, and/or a height between the top surface 134 and bottom surface 133 of the lower starter track 107 are large enough so that the lower starter track 107 can resist bending towards or away from the outside of the building. A width of the bottom surface 133 of the lower starter track 107 allows the anchors of the lower starter track 107 to be attached to a lower surface of the floor slab 101 which is interior to the edge of the floor slab 101. The farther interior the anchor is affixed from the edge of the floor slab 101, the more structural integrity there is between the lower starter track 107 and the floor slab 101. Additionally, the farther interior the anchor is affixed from the edge of the floor slab 101, the fewer anchors will be needed to secure the lower starter track 107 to the floor slab 101.

At least one shim 136 can be located between the top surface 134 of the base 130 of the lower starter track 107 and the bottom surface of the floor slab 101, which shim can be compressed when the lower starter track 107 is attached to the floor slab 101. In some embodiments of the invention, sealant (not shown) can be applied along the lengthwise direction of the lower starter track 107 between a top edge of the top surface 134 of the base 130 and the bottom surface of the floor slab 101 to provide an air, water, fire, and smoke seal between floors of the building. The sealant can be silicone, such as DOW 795, or any other suitable seal material that is known in the art.

The bottom surface 133 of the base 130 of the lower starter track 107 can be mechanically attached or welded to the downward extending head receptor 111.

The head receptor 111 can be mechanically connected or welded to at least one of the bottom surface 133 of the base 130 of the lower starter track 107 and the vertical guide leg 148 of the lower starter track 107. The head receptor 111 can be a lengthwise metal extrusion, such as a steel extrusion.

The head receptor 111 can have a top wall 163, a front wall 165, and a back wall 167, which together form a U or trough like shape. The head receptor 111 can be configured to accept and hold a top of a lower primary window wall substrate (not shown) between the front wall 165 and back wall 167 of the head receptor 111.

The back wall 167 of the head receptor 111 can be a receptor clip. The front wall 165 and back wall 167 of the head receptor 111 can be parallel to each other. The top 163 of the head receptor can have a vertical guide leg 169 located between a front top surface 171 and a back top surface 173 of the top 163 of the head receptor 111, and can extend along a lengthwise direction of the head receptor 111. The vertical guide leg 169 of the head receptor 111 can be perpendicular to the top 163 of the head receptor 111. The back top surface 173 of the head receptor 111 can be mechanically attached or welded to a portion of the bottom surface 161 of the lower starter track 107. A back surface of the vertical guide leg 169 of the head receptor can be mechanically attached or welded to a portion of the wall 159 of the lower starter track 107.

The front wall 165 and the back wall 167 of the head receptor 111 can be parallel to each other. In some embodiments of the invention, the front wall 165 and the back wall 167 of the head receptor 111 are perpendicular to the top 163 of the head receptor 111.

The back wall 167 of the head receptor 111 can abut a front surface of the vertical guide leg 148 of the lower starter track 107. The back wall 167 of the head receptor 111 can be mechanically attached or welded to the vertical guide leg 148 of the lower starter track 107.

The front wall 165 and back wall 167 of the head receptor 111 can have rubber gaskets 122" which provide a water and air seal when the lower primary window wall substrate is held in the head receptor 111. The rubber gaskets 122" can extend along an upper inside portion of the back wall 167 and front wall 165 of the head receptor 111.

The front top surface 171 of the top wall 163 of the head receptor 111 can be mechanically attached or welded to a bottom of each of the at least one down tubes 113. Each down tube 113 can have a rectangular or cylindrical body with a hollow inside portion. The hollow portion of each down tube 113 can be connected to a corresponding at least one opening 142 of the sub sill 109.

Each down tube 113 can have a back wall 147, a front wall 149, and a pair of side walls (not shown) configured to channel water collected by the sub sill 109 to an air channel 115. Each down tube 113 can have an exit 153 located in a portion of the front wall 149 which leads to a corresponding air channel 115. The down tube 113 may have a guide 155 located below the exit 153 configured to guide a flow of water from the down tube 113 through the exit 153 and into the air channel 115. The guide 155 of the water channel 113 may be angled such that a front end of the guide 155 adjacent to the front wall 149 is at a same height as the bottom of the exit 153, and such that a back end of the guide 155 adjacent to the front wall 149 is at a height above the bottom of the exit 153 of the water channel 113.

The down tube 113 may have a top surface (not shown) which can be mechanically attached or welded to the front bottom surface 143 of the bottom 141 of the sub sill 109. The top surface of the down tube 113 can be perpendicular to the back wall 147, front wall 149 and side walls of the down tube 113. The top surface of the down tube 113 may have an opening 151 that is connected to a corresponding opening 142 of the sub sill 109. An upper surface of the back wall 147 of the down tube 113 can abut a front surface of the vertical guide leg 144 of the sub sill 109. A portion of an outside surface of the front wall 149 of the down tube 113 can be located on a same plane as the front wall 137 of the sub sill 109. There may be a space between the back wall 147 of the down tube 113 and a side surface of the floor slab 101 for concrete tolerance. An insulating material can be located between the down tube 113 and a vertical support of the exterior spandrel panel 103. The insulating material can be located between a shadow box panel (not shown) and the space between the back wall 147 of the down tube 113 and the side surface of the floor slab 101.

A portion of the outside surface of the of the front wall 149 of the down tube 113 can be mechanically attached or welded to a back surface of the vertical guide leg 169 of the head receptor 111. A bottom of the down tube 113 can be mechanically attached or welded to the front top surface 171 of the head receptor 111. The front wall of the down tube can be located on a same plane as the front wall of the sub sill 109 and head receptor 111.

The air channel 115 may have a front wall 175, a back wall (not shown), two side walls (not shown), an exit 177, an air guide 180, an air entrance 181, and a water entrance 185. The back wall of the air channel 115 can be the front wall 137 of the sub sill 109, the front wall 165 of the head receptor 111, and the front wall 149 of the down tube 113. The two side walls can be perpendicular to the front wall 175 of the air channel 115 or otherwise forming a vertical enclosure therewith. The front wall 175 of the air channel 115 can be parallel to the front wall 149 of the down tube 113. The air entrance 181 of the air channel 115 can be located above the water entrance 185 of the air channel 115. The water entrance 185 can be located in a back wall (not shown) of the air channel 115 and be connected to the exit 153 of the down tube 113. The water entrance 185 of the air channel 115 can be the exit 153 of the down tube 113. The exit 177 of the air channel 115 may be located below the water entrance 185 of the air channel 115.

The air guide 180 is intended to ensure that there is more air pressure coming into air channel 115 from the air entrance 181 thereof than from the exit 177 thereof. The air guide 180 can be an air scoop mechanically attached or welded to the air entrance 181 and angled to guide air from the outside of the building into the air entrance 181 in order to increase the flow of air into the air entrance 181 of the air channel 115. The air guide 180 can alternatively be an air deflector mechanically attached or welded to the exit 177 of the air channel 115 and angled to inhibit the flow of air from the outside of the building into the exit 177 of the air channel 115 in order to inhibit the flow of air into the exit 177 of the air channel 115. In some embodiments of the invention, the air channel 115 can comprise both an air scoop and/or an air deflector (not shown).

In some embodiments the of the invention, the assembly 100 can include a second down tube which can fit within the down tube 113 and extend through the at least one hole 142 of the sub sill 109. An entrance of the second down tube can be located above the down tube 113. An air tube (not shown) can have an opening to the outside of the building and an exit to the inside of the down tube 113. The exit of the air tube can be located above an exit of the second down tube.

An exterior spandrel panel unit 103 can be attached to the spandrel assembly 100 to cover the edge of the floor slab 101. The exterior spandrel panel 103 can be aesthetic as well as serve utilitarian purposes of creating a water and air seal between an outside 104 of the building. The exterior spandrel panel 103 can be made from glass, stone, metal, any other suitable material, or any combination thereof. The exterior spandrel panel unit 103 can be attached to an outside of the front wall 137 of the sub sill 109, and to an outside of front wall 165 of the head receptor 111.

Figure 2C:
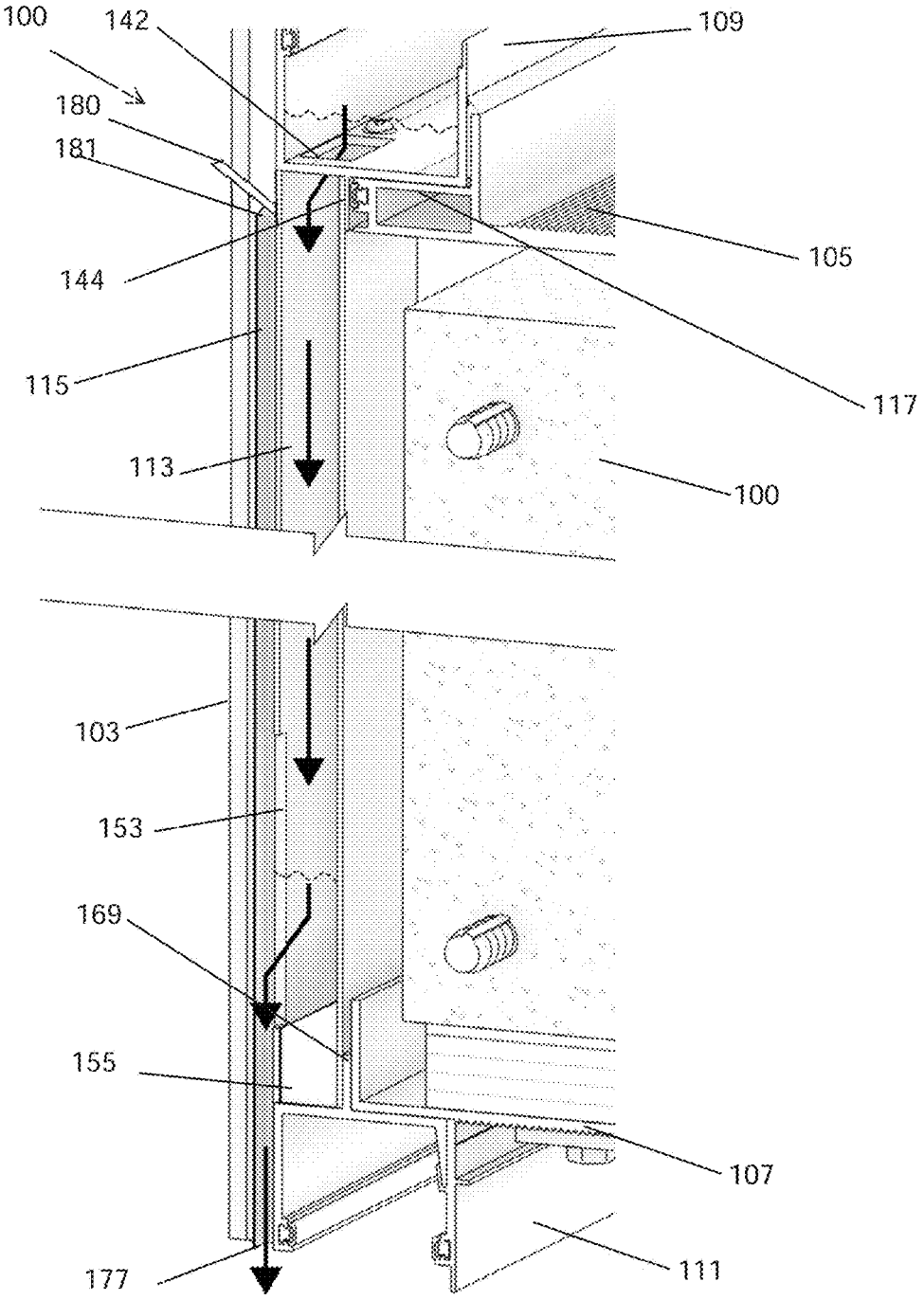
FIG. 2C is a close-up view of a cutaway perspective view of a water draining spandrel assembly, according to another embodiment of the invention.

Reference is made to FIG. 2C, which is a close-up view of a cutaway perspective view of an alternative embodiment of the water draining spandrel assembly 100 of FIG. 2A. as shown in FIG. 2C, the air entrance 181 of the air channel 115 can be located below the at least one hole 142 of the sub sill 109 and above the exit 153 of the downtube. The air guide 180 can be attached or welded to the air entrance 181 and angled to guide air from the outside of the building into the air entrance 181 in order to increase the flow of air into the air entrance 181 of the air channel 115.

Figure 2D:
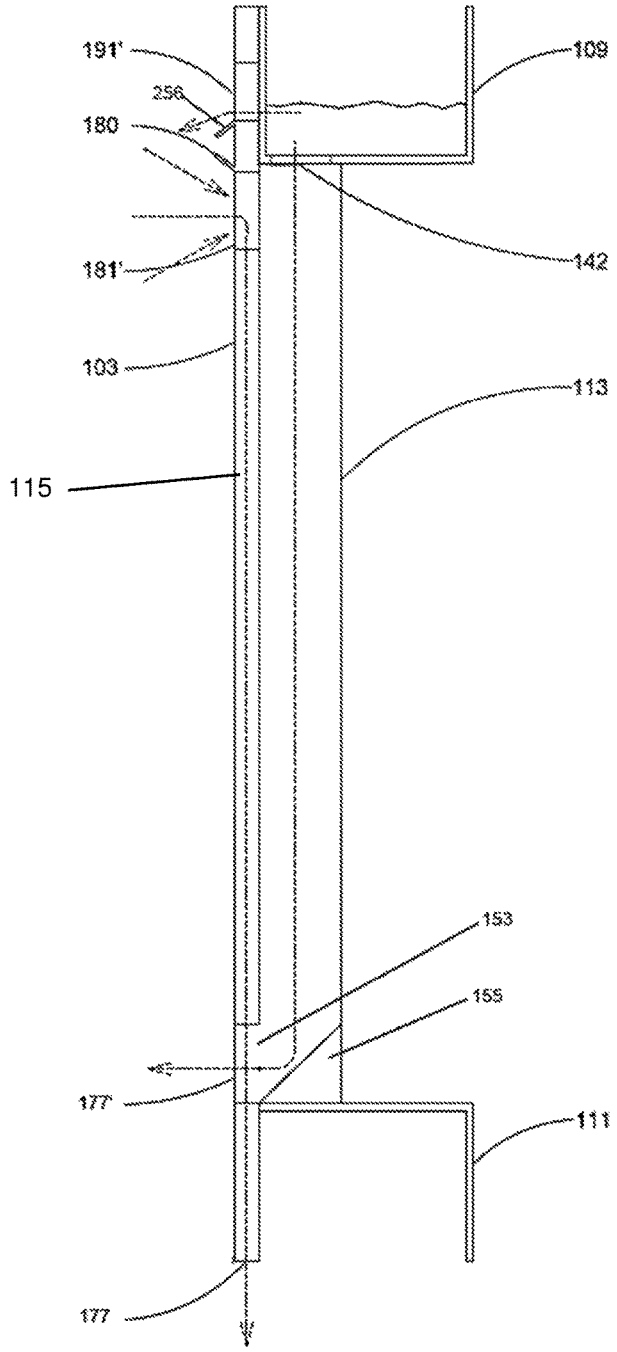
FIG. 2D is a close-up cutaway side view of a water draining spandrel assembly, according to an alternative embodiment of the invention.

Reference is made to FIG. 2D, which is a close-up side view of a cutaway perspective view of an alternative embodiment of the water draining spandrel assembly 100 of FIG. 2A. In FIG. 2D, in the case of water damming, or any other issue which may prevent water that has accumulated in sub sill 109 from leaving the building via downtube 113, water can exit the sub sill 109 via a scupper 191', an opening in the sub sill. The scupper 191' may be configured with a operable top hung flap (not shown), such that it opens only outward, away from the building, and does not open inward, towards the sub sill 109, and only when required for water to drain. If the scupper opening 191' were open no matter the case to drain or not to drain, excluding exterior air, weather cold or hot from entering the sub-sill and influencing interior surface temperatures of sub-sill would be an unwanted condition. The top hung flap of the scupper 191' may be weighted or otherwise configured such that it is opened only once a predetermined volume and/or weight of water is collected in the sub sill 109. The scupper 191' may have a deflector extending from the bottom thereof which draws drained water leaving the sub sill 109 from scupper 191' in a direction away from air scoop 180.

In FIG. 2D, an air entrance 181', which allows air from outside the building to enter the downtube 113, may be located below the at least one hole 142 of the sub sill 109. A primary exit 177' may be connected to the downtube 113 and the air channel 115. The primary exit 177' may have a hinged top hung flap (not shown) which is such that it opens only outward, away from the building, and does not open inward, towards the downtube 113. The top hung flap of the primary exit 177' may be weighted or otherwise configured such that it opens only to the outside of the building if the amount or weight of water collected in the downtube 113 and/or sub sill 109 is less than what is required to overcome the exterior air pressure, e.g., a predetermined weight. If the amount or weight of water collected in the downtube 113 and/or sub sill 109 is sufficient to overcome the exterior air pressure, then water flowing through the downtube 113 is channeled through the exit 153 into or through the air channel 115 and out to the exterior of the building via primary exit 177', the shortest distance, or exit 177. Exit 177 may have a deflector attached to it to deflect air from entering the air channel 115 via the exit 177.

In some embodiments of the invention, the downtube 113 may have a second scupper (not shown) located above the primary exit 177' configured to allow water to exit to the exterior of the building if primary exit 177' and/or exit 177 are blocked or clogged.

Figure 3:
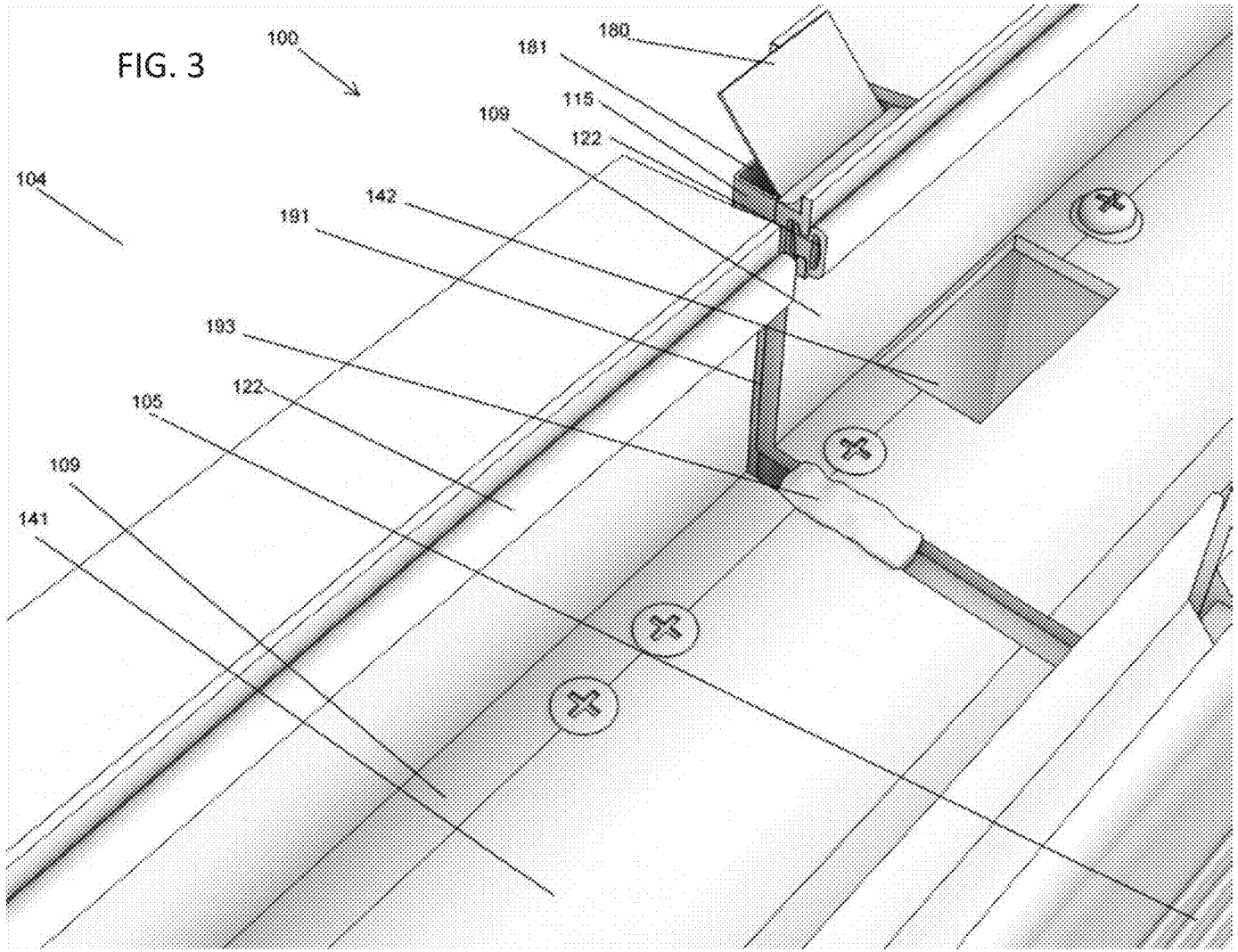
FIG. 3 is a top perspective view of the water draining spandrel assembly of a window wall system of a building, according to one embodiment of the invention.

Reference is made to FIG. 3, which is a top perspective view of water draining spandrel assembly 100 of a window wall system of a building, according to one embodiment of the invention.

As shown in FIG. 3, the water draining spandrel assembly 100 can include more than one connected sub sill 109. Each of the more than one connected sub sill 109 can be mechanically connected or welded to the upper starter track 105. In some embodiments of the invention, there may be more than one connected upper starter track 105; however, in order to increase structural integrity of the assembly 100, a connection of any two adjacent upper starter tracks 105 is, in preferred embodiments, not aligned with a connection of two adjacent sub sills 109. The connection between two adjacent upper starter tracks 105 can include a vertical marriage bead 193. The vertical marriage bead 193 may be a sealant such as silicone, such as DOW 795, or any other suitable seal material that is known in the art, along with a pre cured sheet of silicone, for example DOW 123 strip or equal.

At least one vertical slit 191 can be located in the front wall 137 of the sub sill 109. The at least one vertical slit 191 can lead to the outside 104 of the building and can be used to allow water collected in the sub sill 109 to exit to the outside 104 of the building. The at least one vertical slit 191 can be located at a connection point between two adjacent sub sills 109. Rubber gaskets 122 can be located on an upper inside portion of the front walls 137 of the sub sills 109.

The air channel 115 can be mechanically connected or welded to an outside of the dry verticals and not to any horizontal surface, such as the sub sill 109 or head receptor 111. In some embodiments of the invention, the air channel 115 can be connected the wet down tube 113 and not to the dry verticals. The air guide 180 can be can be an air scoop mechanically attached or welded to the air entrance 181, and angled to guide air from the outside 104 of the building into the air entrance 181 in order to ensure that there is more air pressure coming into air channel 115 from the air entrance 181 than from the exit 177. The air entrance 181 can be located outside 104 of the building. The air entrance 181 can be located above the opening 142 in the sub sill 109. The opening 142, located in the bottom wall 141 of the sub sill 109, can lead to the down tube 113.

Figure 4:
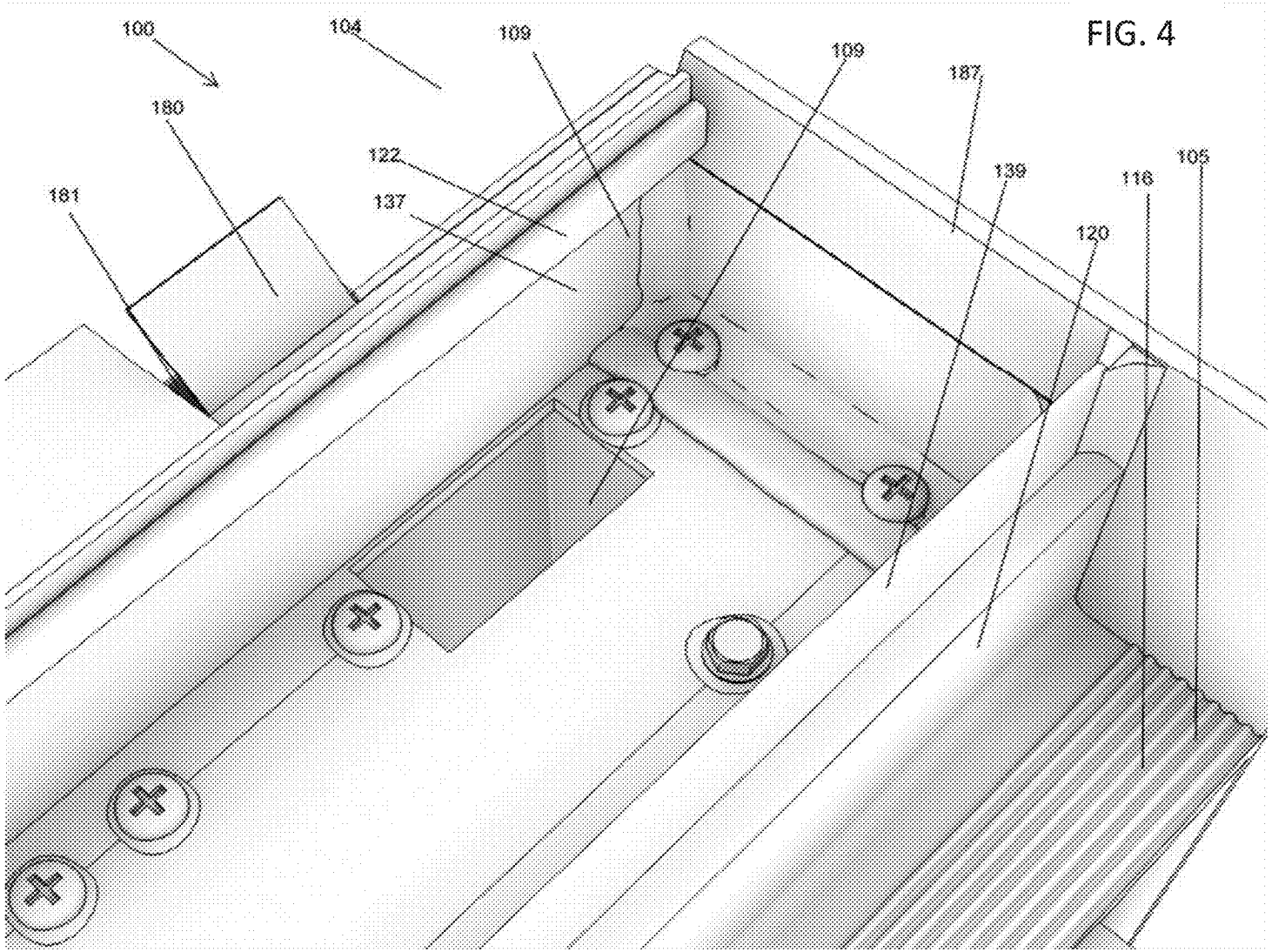
FIG. 4 is a top perspective view of a termination of the water draining spandrel assembly of a window wall system of a building, according to one embodiment of the invention.

Reference is made to FIG. 4, which is a top perspective view of a system termination of the water draining spandrel assembly 100 of a window wall system of a building, according to one embodiment of the invention.

As shown in FIG. 4, the water draining spandrel assembly 100 can be connected to a wall 187 at an end of the sub sill 109 and upper starter track 105. The back wall 139 of the sub sill 109 can be connected to a front surface of the vertical guide leg 120 of the upper starter track 105. The back top surface 116 can be serrated. The rubber gasket 122 can be located on an upper inside portion of the front wall 137 of the sub sill 109. The air guide 180 can be an air scoop mechanically attached or welded to the air entrance 181 and angled to guide air from the outside 104 of the building into the air entrance 181. The air entrance 181 can be located above the opening 142 located in the bottom wall 141 of the sub sill 109.

Figure 5:
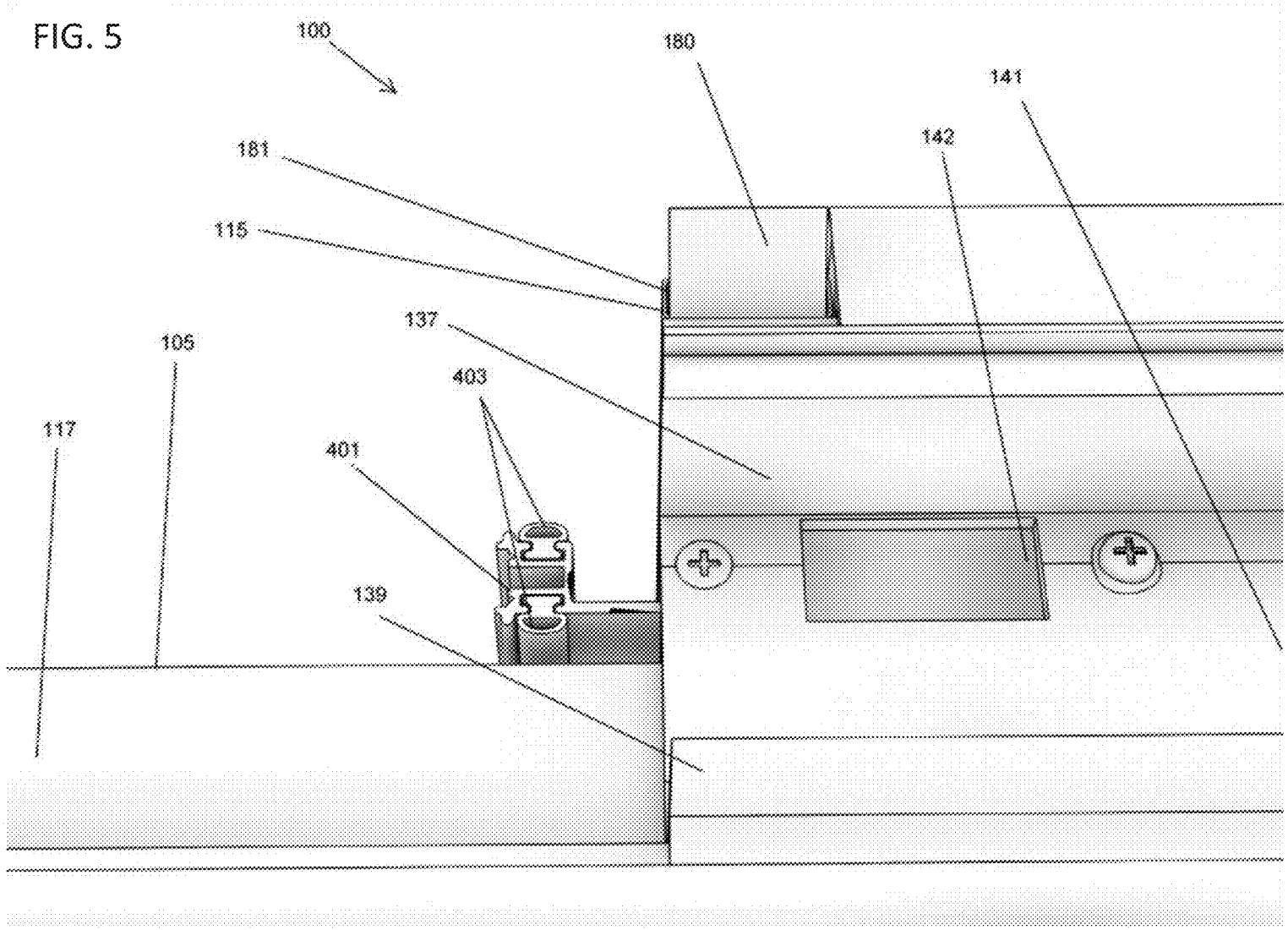
FIG. 5 is a top perspective view of a midsection of the water draining spandrel assembly of a window wall system of a building, according to one embodiment of the invention.

Reference is made to FIG. 5 which is a top perspective view of a midsection of the water draining spandrel assembly 100 of a window wall system of a building, according to one embodiment of the invention.

As shown in FIG. 5, the water draining spandrel assembly 100, the sub sill 109 can have a front wall 137, a back wall 139, and a bottom wall 141. The bottom surface (not shown) of the bottom wall 141 of the sub sill 109 can be attached to the front top surface 117 of the upper starter track 105. The opening 142 in the bottom wall 141 of the sub sill 109 can be located in a portion of the bottom wall 141 of the sub sill 109 which is not above the front top surface 117 of the upper starter track 105. The air channel 115 can be attached to an outside (not shown) of the front wall 137 of the sub sill 109, and the air entrance 181 and the air guide 180 can be located at a height which is above the hole 142 of the sub sill 109. The down tube 113 (not shown in FIG. 5) can have a connector 401 with rubber gaskets 403. The connector 401 of the down tube 113 can be connected to a vertical support of an adjacent external spandrel unit.

Figure 6:
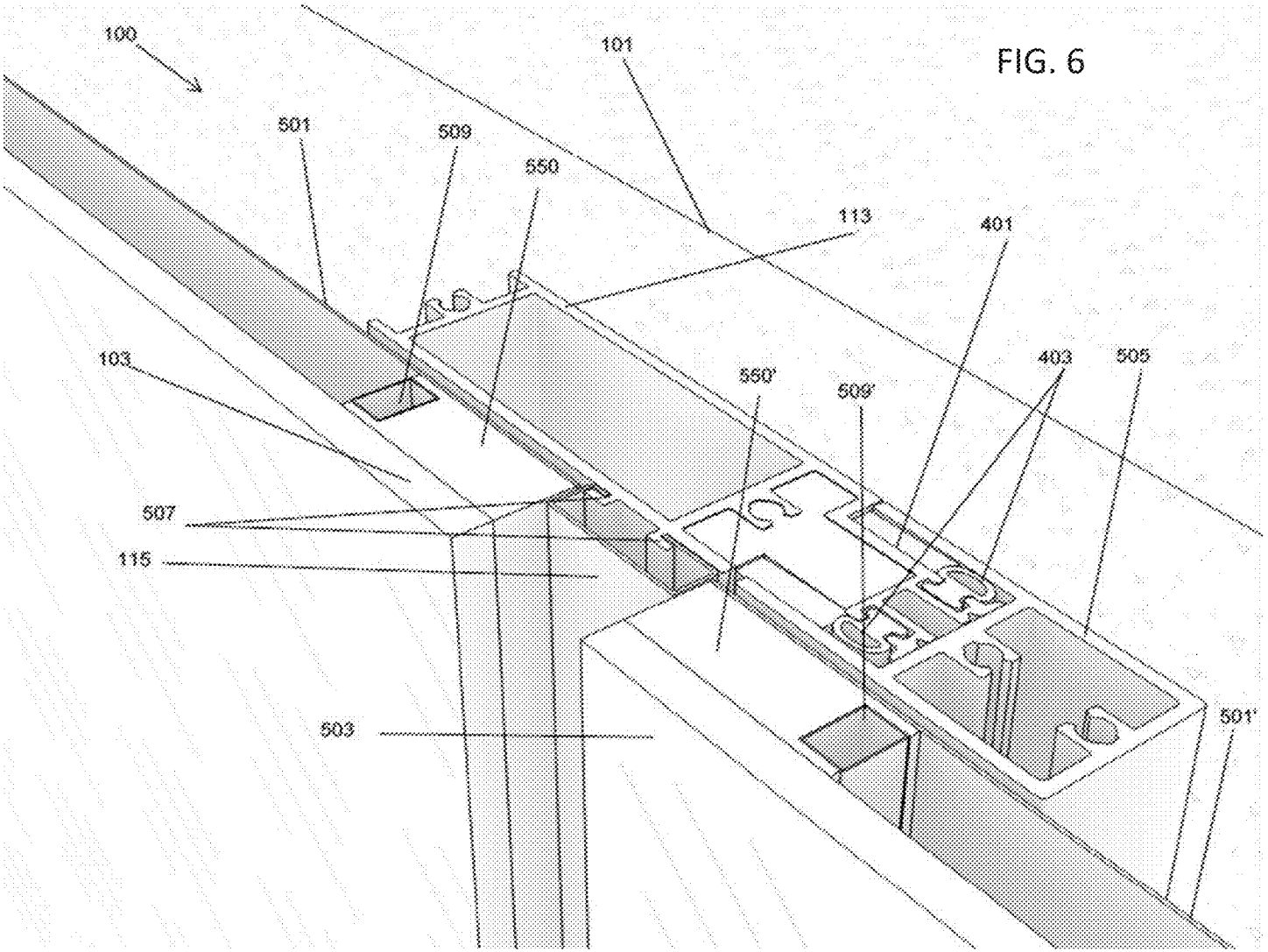
FIG. 6 is a top cutaway perspective view of the midsection of the water draining spandrel assembly of a window wall system of a building, according to one embodiment of the invention.

Reference is made to FIG. 6, which is a top cutaway perspective view of the midsection of the water draining spandrel assembly 100 of a window wall system of a building, according to one embodiment of the invention.

As shown in FIG. 6, the down tube 113 can be located between the exterior spandrel panel unit 103 and an outside edge of the floor slab 101. An outside of the front wall 149 of the down tube 113 can be connected to a shadow box panel 501 of the exterior spandrel panel 103. The down tube 113 can be connected to a vertical support 505 of an adjacent exterior spandrel panel 503 via the connector 401. The connector 401 can have rubber gaskets 403 to seal the connection between vertical support 505 and down tube 113. The vertical support 505 of the adjacent exterior spandrel panel 503 can have a hollow inside section. The vertical support 505 of the adjacent exterior spandrel panel 503 can be connected to a shadow box panel 501' of the adjacent exterior spandrel panel 503. The shadow box panel 501 can be connected to the exterior spandrel panel 103 via a vertical spacer 509 and sealant 550, such as silicone or another suitable sealant. The shadow box panel 501' can be connected to the exterior spandrel panel 503 via a vertical spacer 509' and sealant 550', such as silicone or another suitable sealant. The shadow box panels 501 and 501' can be a thin sheet. The shadow box panels 501 and 501' can be made of any suitable material, for example a thin metal, such as aluminum or steel. The thickness and elasticity of the shadow box panels 501 and 501' compared to the exterior spandrel panel 103 can be configured to avoid pillowing or oil canning of the exterior spandrel panel 103. Similarly, an exterior window panel attached to primary window wall substrate 601 can include a shadow box panel that is configured to avoid pillowing or oil canning of the exterior window panel. The primary window wall substrate 601 can be the insulated panel (1000, 1001, and 1005), as described hereinbelow in FIGS. 10A-E.

The air channel 115 can be connected to an outside of the front wall 149 of the downtube 113 that is not connected to the shadow box panel 501 of the exterior spandrel panel 103. In one embodiment, the air channel 115 can be connected to the outside of the front wall 149 of the downtube 113 via a groove or track 507 located on the outside of the front wall.

Figure 7A:
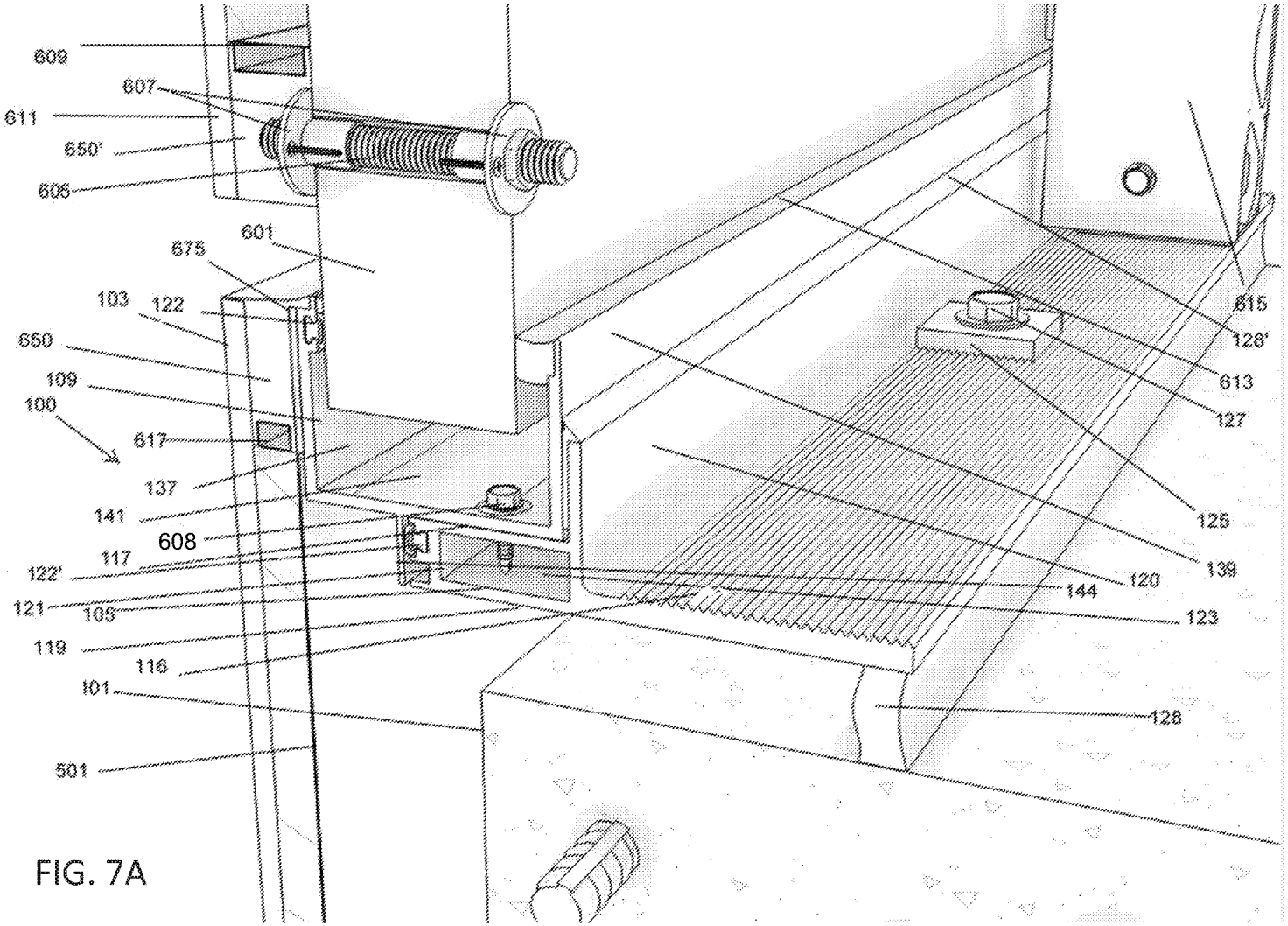
FIG. 7A is a cutaway perspective view of the water draining spandrel assembly of a window wall system of a building showing a primary window wall substrate, according to one embodiment of the invention.
Figure 7B:
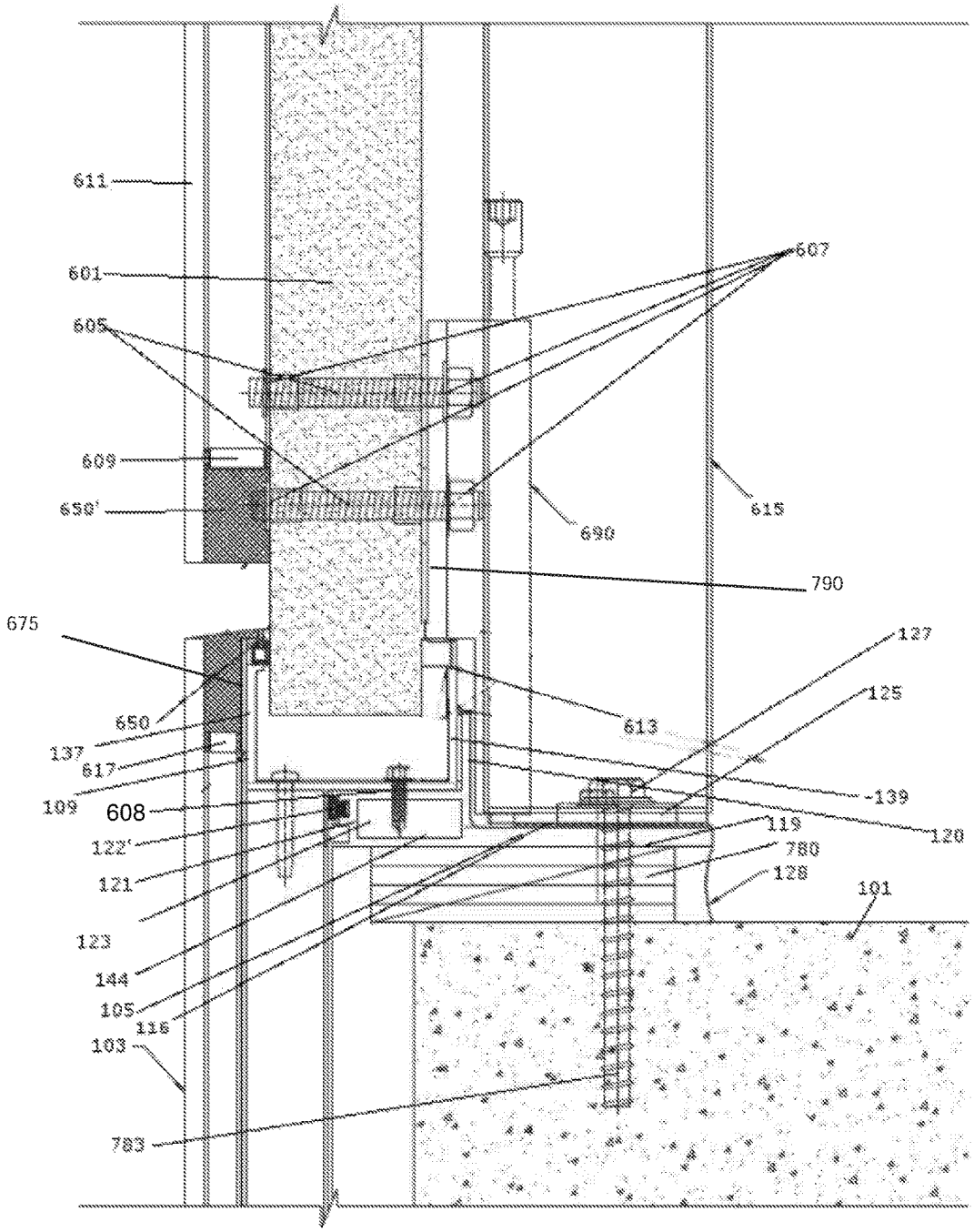
FIG. 7B is a cutaway side view of the water draining spandrel assembly of a window wall system of a building showing a primary window wall substrate, according to one embodiment of the invention.

Reference is made to FIGS. 7A and 7B, which are cutaway perspective and side views, respectively, of the water draining spandrel assembly 100 of a window wall system of a building showing a primary window wall substrate 601.

As shown in FIGS. 7A-B, the bottom 141 of the sub sill 109 can be attached to the front top surface 117 of the upper starter track 105 via a screw 608, and the connection can be sealed. If the seal on the screw 608 is compromised, the lengthwise hollow area 123 of the upper starter track 105 can collect water from the inside of the sub sill 109 to prevent this water from reaching an interior of the building.

The primary window wall substrate 601 can be connected to an inside of the building using a threaded rod 605 and two T-nuts 607. A back end of the threaded rod 605 can be used to attach the primary window wall substrate 601 to an inside of the building such that there is a space between the bottom of the primary window substrate 601 and a top surface of the bottom 141 of the sub sill 109. The primary window wall substrate 601 can be metal, wood, stone, brick, or an insulating material. In some embodiments of the invention, the primary window wall substrate 601 can be a structurally insulated panel. For example, the primary window wall substrate 601 can be a layer of foam sandwiched between two sheets, such as two thin sheets of metal. The insulation layer can be mineral wool, foam, a vacuum insulated panel, or any other type of insulating layer.

In contrast, typical window wall systems have aluminum extrusions which span from an inside to an exterior of the building. Aluminum extrusions create thermal bridging that increases the heat flow to the exterior and causing the interior surface temperatures to drop below the dew point. Similarly, aluminum frame shapes designed for use in exterior building envelope enclosures readily allow energy, both heat and vibrations, to pass through it. This can increase the risk of condensation on an interior dry side of the system. One solution to this problem is to design the aluminum extrusions with a thicker interior to act as a heat sink, e.g., to design the aluminum shapes with increased mass on the interior to act as a sink for both heat and vibration, energy. Another solution is to use thermal breaks, which are heat insulating material such as reinforced polyamide plastic, urethane and the like. However, thermal breaks typically provide only a modest benefit, are difficult to value for long term structural integrity, and have unpredictable life spans. Some embodiments of the present invention may reduce energy, both heat and/or vibrations, from impacting performance of the exterior building envelope enclosure, e.g., by thermal bridging, including the risk of condensation on an interior dry side of the assembly by connecting the primary window wall substrate 601 to an interior dry side of the system by using intermittingly/sporadically placed threaded rods 605.

A horizontal spacer 609 can be located between the primary window wall substrate 601 and an exterior window panel 611. Sealant 650' can be applied between the exterior window panel 611, the primary window wall substrate 601, the horizontal spacer 609, and an outside of the building. A front end of the threaded rod 605 can be used to attach the primary window wall substrate 601 to the sealant 650' of exterior window panel 611. By connecting the front end of the threaded rod 605 to the sealant 650', the threaded rod 605 further reduces thermal bridging from the outside of the building and the inside of the building.

Sealant 613 can be applied between an upper inside portion of the back wall 139 of the sub sill 109 and an outside back portion of the primary window wall substrate 601 in order to create an air and water seal. Sealant 613 can be silicone, for example DOW 121 silicone, or some other suitable sealant.

A bottom of a structural support beam 615 can be connected to the back top surface 116 of the upper starter track 105. A top (not shown) of the structural support beam 615 can be attached to a bottom surface of a lower starter track (not shown) attached to an upper floor slab (not shown) above floor slab 101. The shadow box panel 501 can be connected to the exterior spandrel panel 103 via an upper horizontal spacer 617. Sealant 650, such as silicone, can be located between the shadow box panel 501, the front wall 137 of the sub sill 109, the upper horizontal spacer 617, and the outside of the building. The sealant 650 can be attached to an outside surface of the front wall 137 of the sub sill 109 via acrylic adhesive tape 675.

As shown in FIG. 7B, at least one shim 780 can be located between the bottom surface 119 of the upper starter track 105 and an upper surface of the floor slab 101, which shim 780 can be compressed when the upper starter track 105 is attached to the floor slab 101.

The upper starter track 105 can be attached to the floor slab 101 by inserting at least one anchor 127 downward through the back top surface 116 and bottom surface 119 of the upper starter track 105, and into an upper surface of the floor slab 101. The at least one anchor 127 can be inserted into a washer 125.

At least two threaded rods 605 can be attached to the primary window wall substrate 601. A back end of the two threaded rods 605 can be attached to a leveling block 690. The back end of the two threaded rods 605 can be attached to the leveling block 690 via a bracket 790. In some embodiments of the invention, there is no leveling block 690, and the back end of the two threaded rods 605 can be attached to the bracket 790. A front end of the two threaded rods 605 can be connected to the exterior window panel 611 via sealant 650'.

Figure 8A:
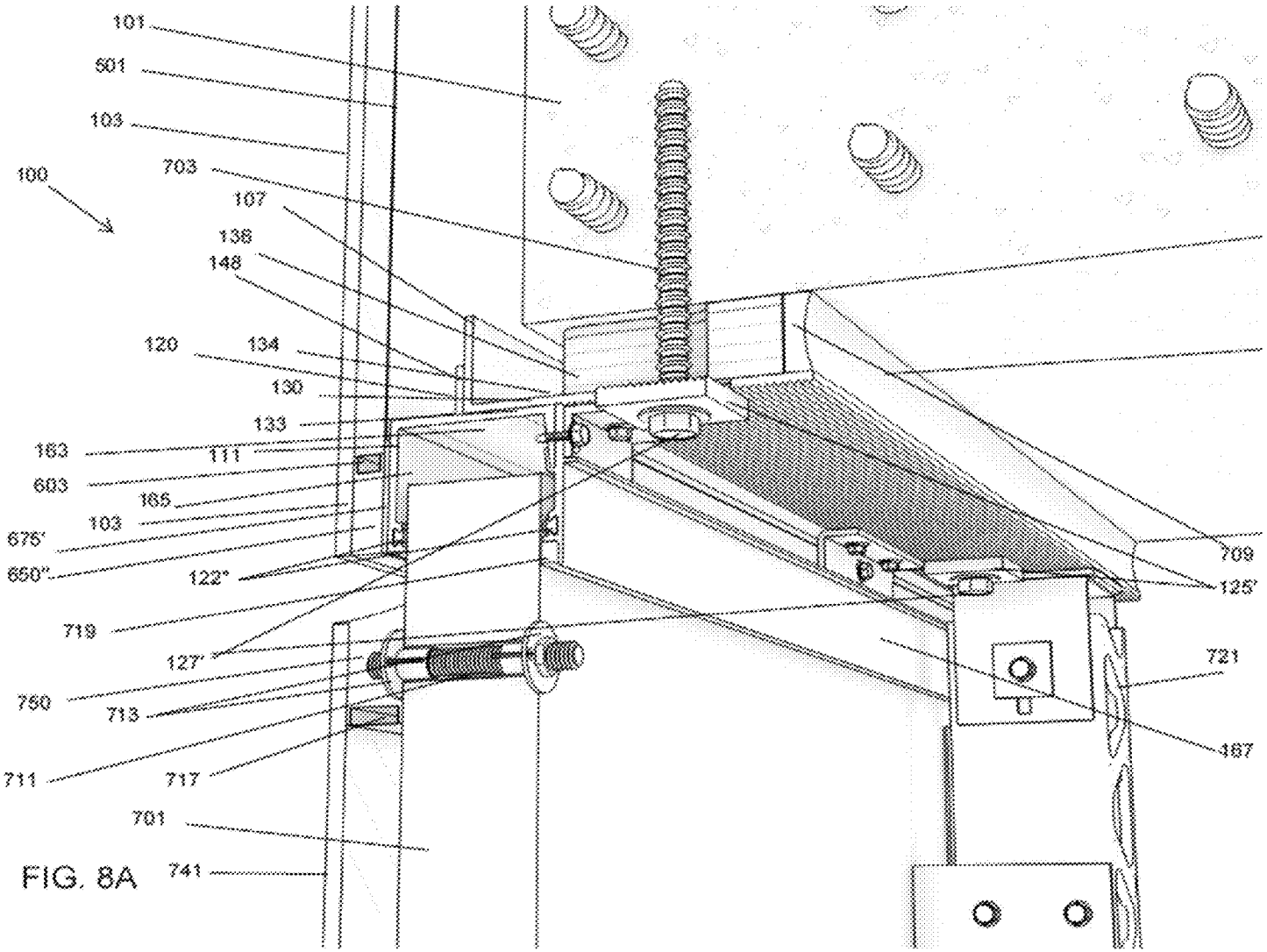
FIG. 8A is a cutaway perspective view of the water draining spandrel assembly of a window wall system of a building showing a lower spandrel and a higher primary window wall substrate, according to one embodiment of the invention.
Figure 8B:
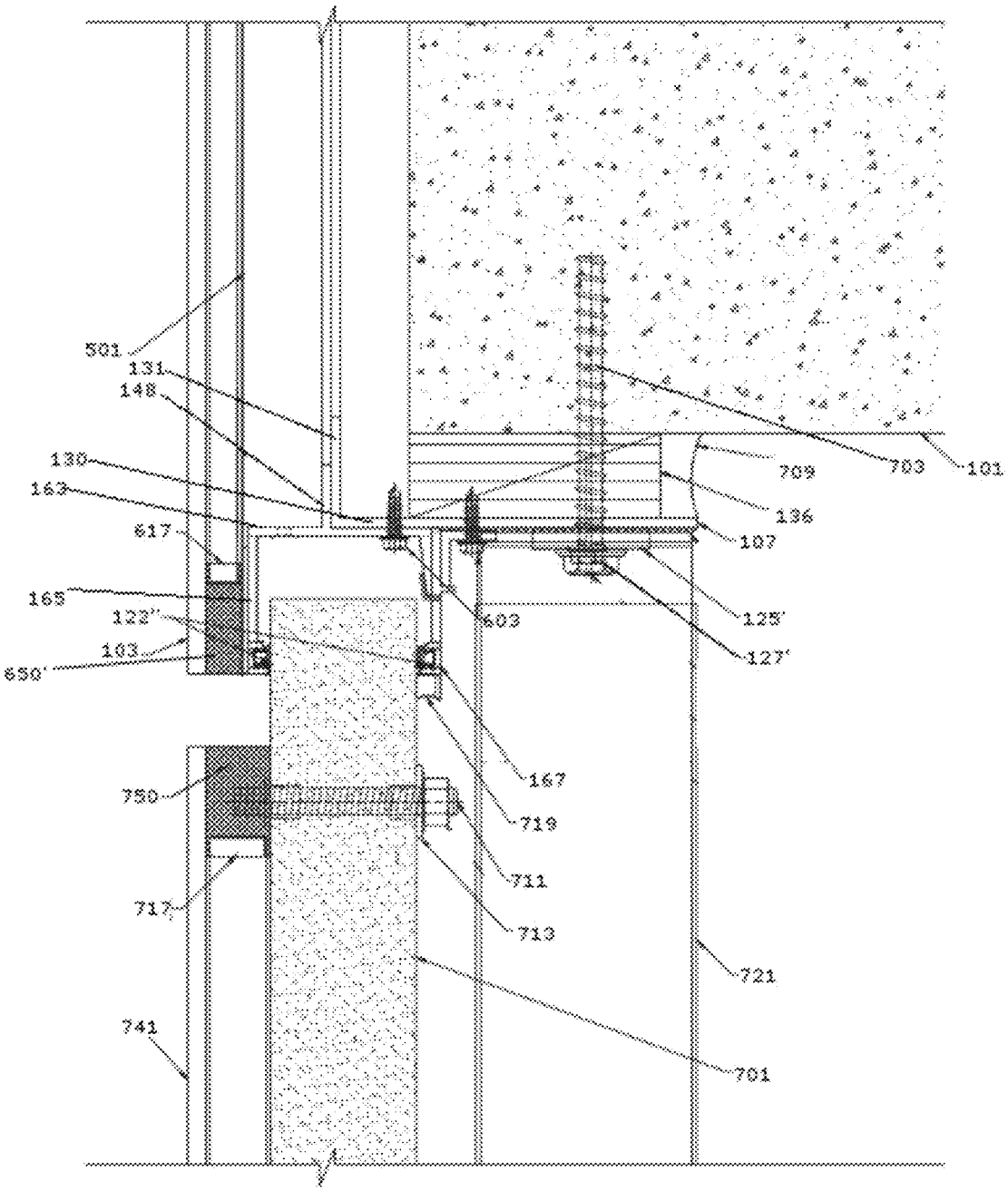
FIG. 8B is a cutaway side view of the water draining spandrel assembly of the window wall system of the building showing the lower spandrel and a higher primary window wall substrate.

Reference is made to FIGS. 8A and 8B, which are cutaway perspective and side views of the water draining spandrel assembly 100 of a window wall system of a building showing a lower primary window wall substrate 701.

As shown in FIGS. 8A and 8B, lower starter track 107 can be attached to the floor slab 101 by inserting at least one anchor 703 upward through a bottom surface 133 and a top surface 134 of the base 130 of the lower starter track 107, and into a bottom surface of the floor slab 101. Sealant 709 can be applied along the lengthwise direction of the lower starter track 107 between a top edge of the top surface 134 of the base 130 and the bottom surface of the floor slab 101 to provide an air, water, fire, and smoke seal between floors of the building. The sealant can be silicone, such as DOW 795, or any other suitable sealant.

A top of a structural support beam 721 can be connected to the bottom surface 133 of the base 130 of the lower starter track 107. A bottom (not shown) of the structural support beam 721 can be attached to a top surface of an upper starter track (not shown) attached to a lower floor slab (not shown) below floor slab 101.

A horizontal spacer 717 can be located between a lower primary window wall substrate 701 and a lower exterior window panel 741. Sealant 750, such as silicone or another suitable sealant, can be applied between the lower exterior window panel 741, the lower window wall substrate 701, the horizontal spacer 717, and an outside of the building.

The lower primary window wall substrate 701 can be connected to an inside of the building using a threaded rod 711 and two T-nuts 713. A back end of the threaded rod 711 can be used to attach the lower primary window wall substrate 701 to an inside of the building such that there is a space between the top of the primary window substrate 701 and a bottom surface of the top of the head receptor 111. A front end of the threaded rod 711 can be used to attach the lower primary window wall substrate 701 to the sealant 750 of a lower exterior window panel 741.

Sealant 719 can be applied between a lower edge of the inside of the back wall 167 located below the gasket 122" of the back wall 167 of the head receptor 111. Sealant 719 can be silicon, for example DOW 121 or some other suitable sealant known in the art.

The shadow box panel 501 can be connected to the exterior spandrel panel 103 via a lower horizontal spacer 603 and sealant 650". The sealant 650" can be attached to an outside surface of the front wall 165 of the head receptor 111 via acrylic adhesive tape 675'.

Figure 9A:
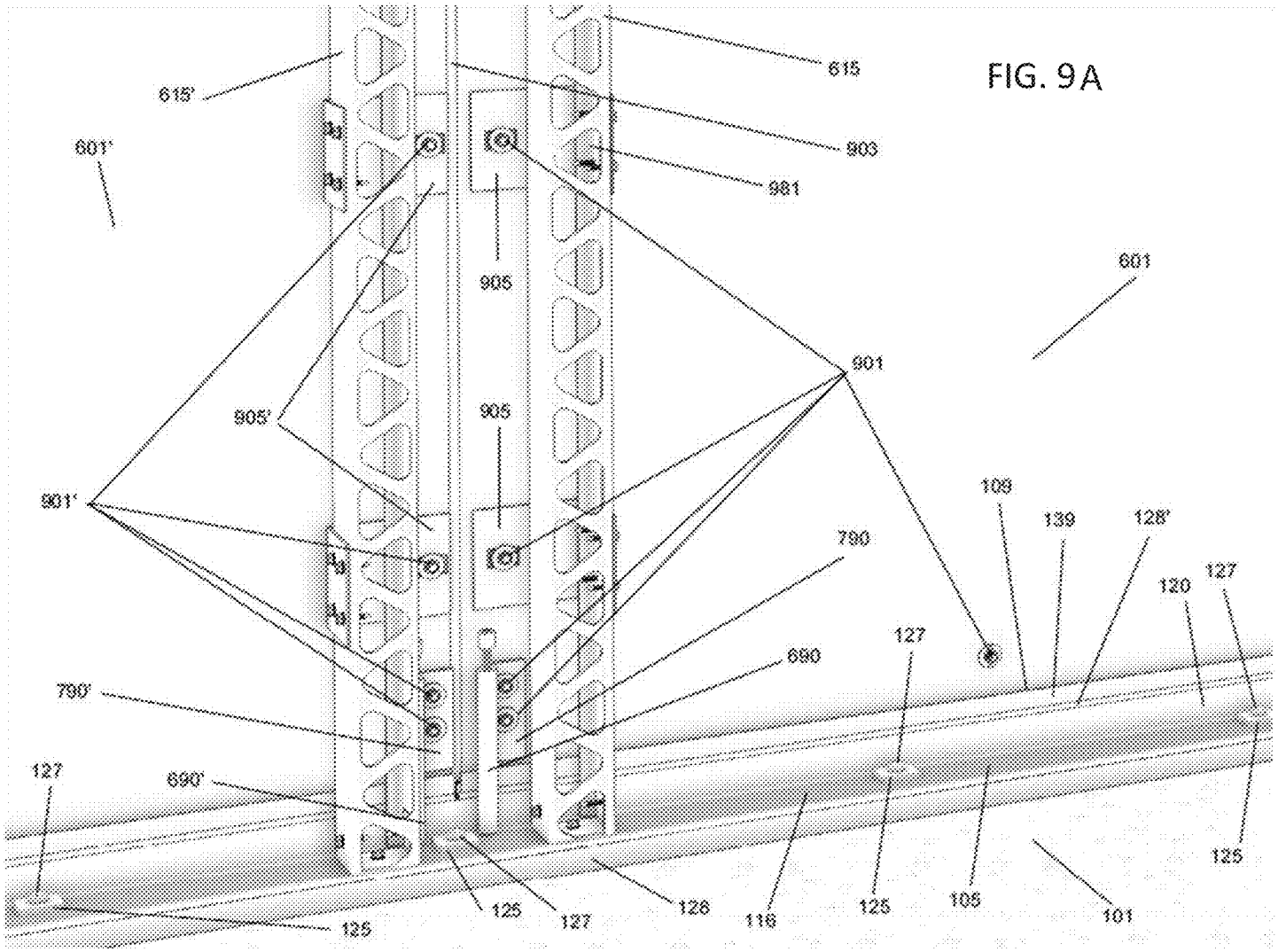
FIG. 9A is a view of the window wall assembly engaged with water draining spandrel assembly of the window wall system of the building from the inside of the building, according to one embodiment of the invention.
Figure 9B:
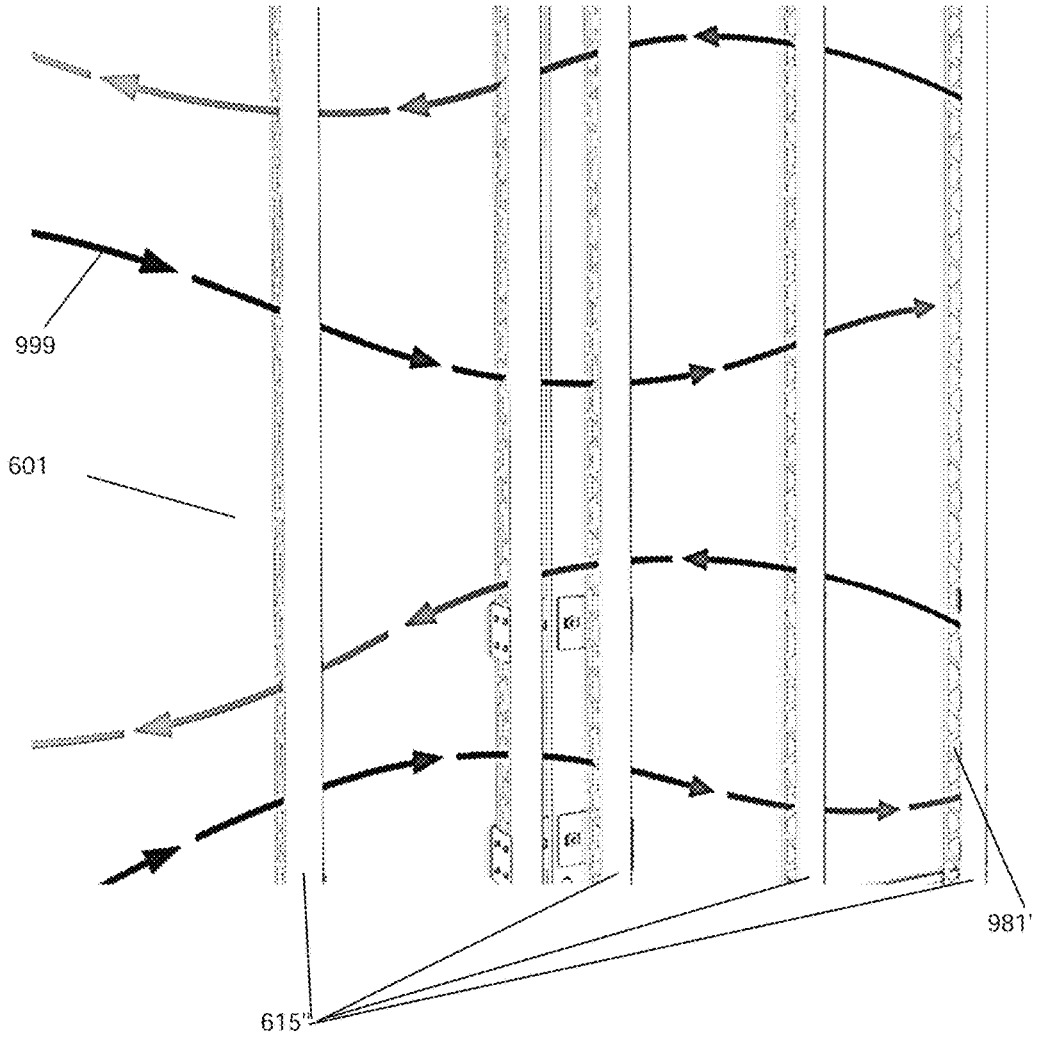
FIG. 9B is a view of the of the window wall assembly fastened to dry side vertical reinforcement having holes designed into the web and designed to assist horizontal and vertical flow of heat radiating through finished sheet rock wall assembly, according to one embodiment of the invention.

Reference is made to FIGS. 9A and 9B, which are views of the water draining spandrel assembly of the window wall system of the building from the inside of the building.

As shown in FIG. 9A, a back end 901 of each threaded rod 605 can extend out of the primary window wall substrate 601 in a direction towards the inside of the building. A back end 901' of each threaded rod 605 of an adjacent primary window wall substrate 601' can extend out of the adjacent primary window wall substrate 601' in a direction towards the inside of the building. The leveling block 690 can be attached to two or more back ends 901 via a bracket 790, and the leveling block 690' can be attached to two or more back ends 901' via a bracket 790' . The primary window wall substrate panel 601 can be attached to the structural support beam 615 via the back ends 901 of the threaded rods 605, and the adjacent primary window wall substrate panel 601' can be attached to the structural support beam 615' via the back ends 901' of the threaded rods 605. The bottoms of structural support beams 615 and 615' can be connected to the back top surface 116 of the upper starter track 105. A top (not shown) of the structural support beams 615 and 615' can be attached to a bottom surface of a lower starter track (not shown) attached to an upper floor slab (not shown) above floor slab 101.

The structural support beams 615 and 615' do not need to be vertical mullions, and the present system does not need or utilize vertical mullions. Rather, the primary air seals of the present invention can include the primary horizontal air seals 128 and 128', and a primary vertical air seal 903. The vertical air seal 903 can be located at a connection point of two adjacent primary window wall substrates 601 and 601'. The vertical seal 903 can extend from the horizontal air seal 128' to a horizontal air seal (not shown) of a lower starter track (not shown) of the upper floor slab (not shown) above floor slab 101. By locating the primary air seals 128, 128' and 903 on an interior side of primary window wall substrates 601 and 601', and not inside vertical mullions, the primary air seals 128, 128' and 903 can be more easily monitored, repaired and/or replaced. The brackets 690 and 691' can be located such that they do not cover the vertical seal 903. The structural support beams 615 and 615' can be located such that they do not cover the vertical seal 903.

The structural support beams 615 and 615' may be hollow. The structural support beams 615 and 615' can have three walls that form a U-like shape. The structural support beams 615 and 615' can have a plurality of cut out sections 981 in one of the walls of the structural support beams 615 and 615' in order to decrease the weight of the structural support beams 615 and 615' as well as to ensure that nothing but the upper starter track 109, a lower starter track (not shown) of the upper floor slab (not shown) above floor slab 101, and the primary window wall substrate 601 are attached to the structural support beams 615 and 615'.

As shown in FIG. 9B, the structural support beams 615" can have a plurality of cut out sections 981' that are perpendicular to the insulated panel 601 such that air can flow in a direction 999 substantially parallel to insulated panel 601. Sheet rock or some other suitable construction material (not shown) can be installed such that the structural support beams 615" are located between the sheet rock and the primary window wall substrates 601 and 601'. The cut out sections 981' assist distribution of heat which radiates through a finished sheet rock wall assembly.

Reference is made to FIGS. 10A-E, which are cutaway perspective views of an insulated window wall substrate 1000, according to one embodiment of the invention. The insulated window wall substrate 1000 can include a layer of insulation 1001 sandwiched between a thin exterior metal sheet 1003 and a thin interior metal sheet 1005. The layer of insulation 1001 can be foam, wool, or any other suitable type of insulating layer.

Figure 10A:
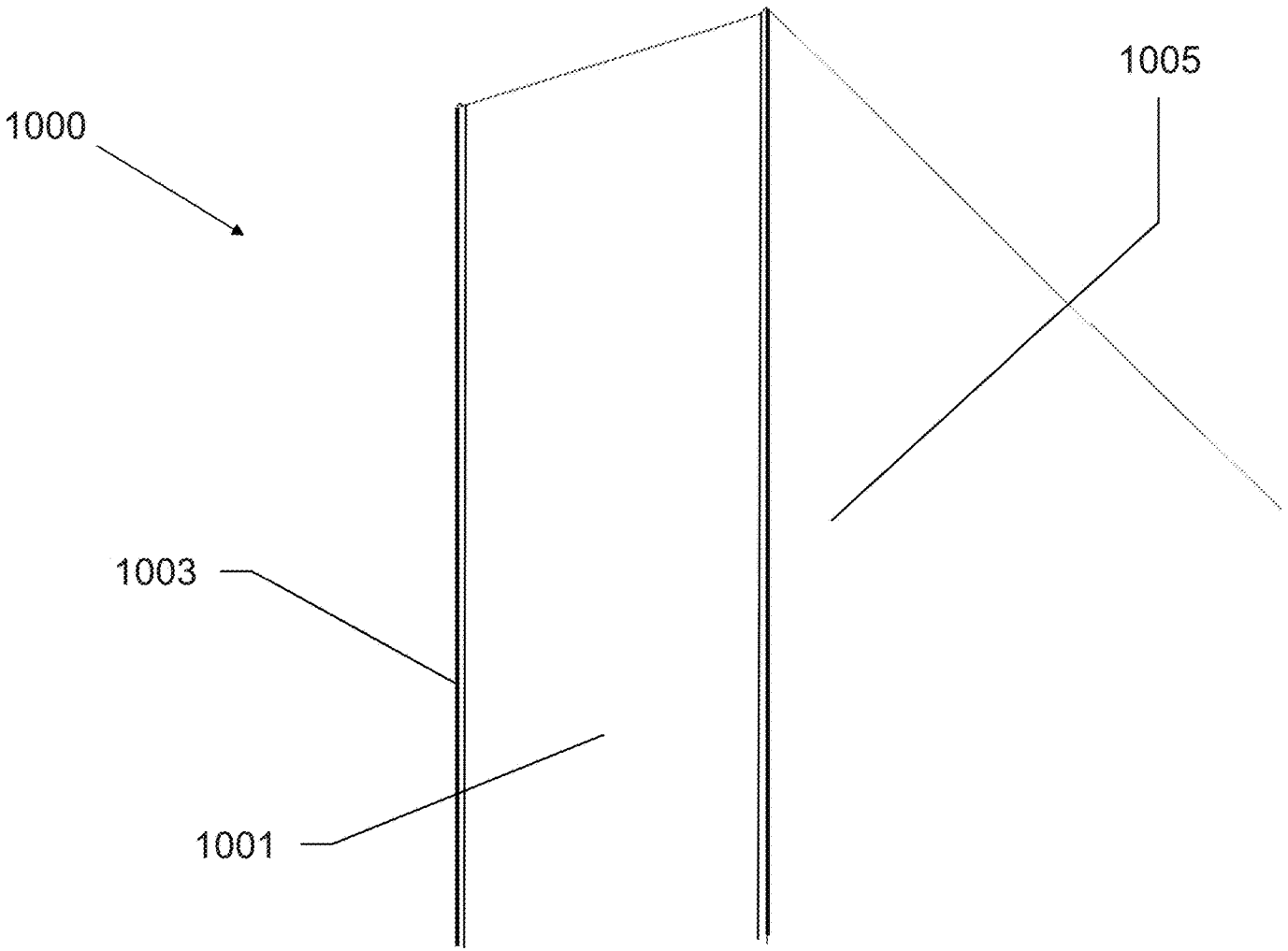
FIG. 10A-E are cutaway perspective views of a primary window wall substrate, according to one embodiment of the invention.
Figure 10B:
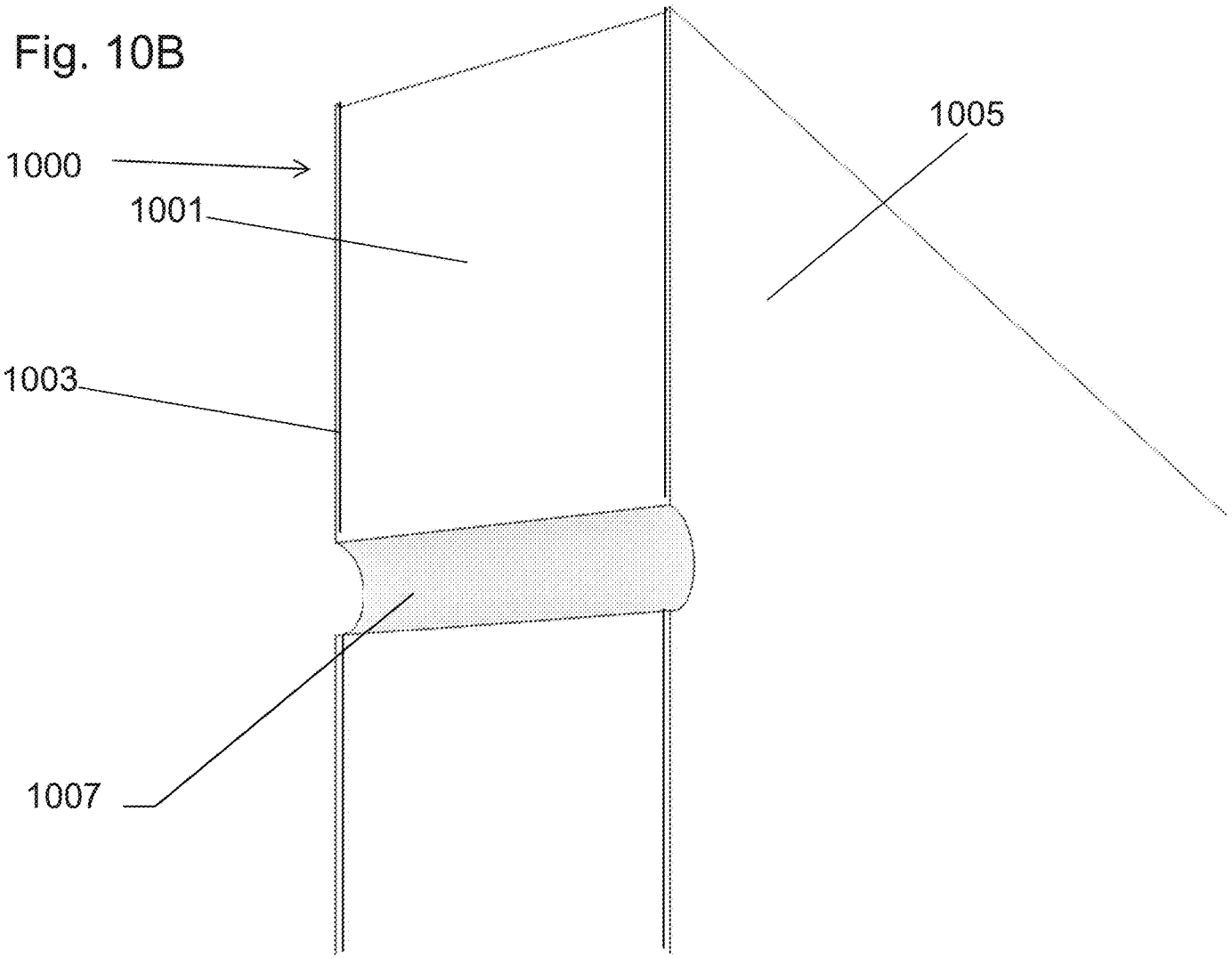

As can be seen in FIG. 10B, the primary window wall substrate 1000 may include an access hole 1007 that can be bored through the primary window wall substrate 1000.

Figure 10C:
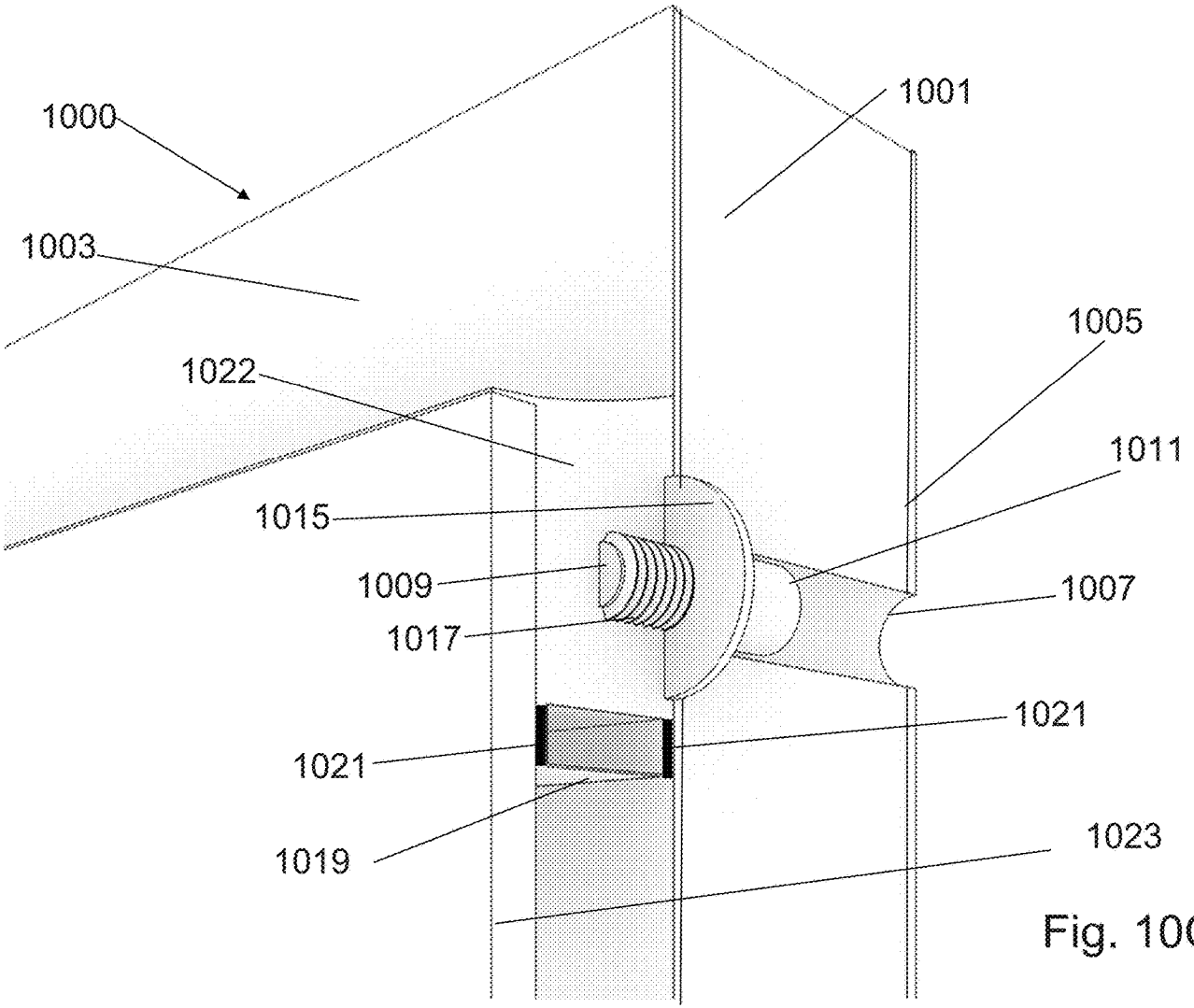
Figure 10D:
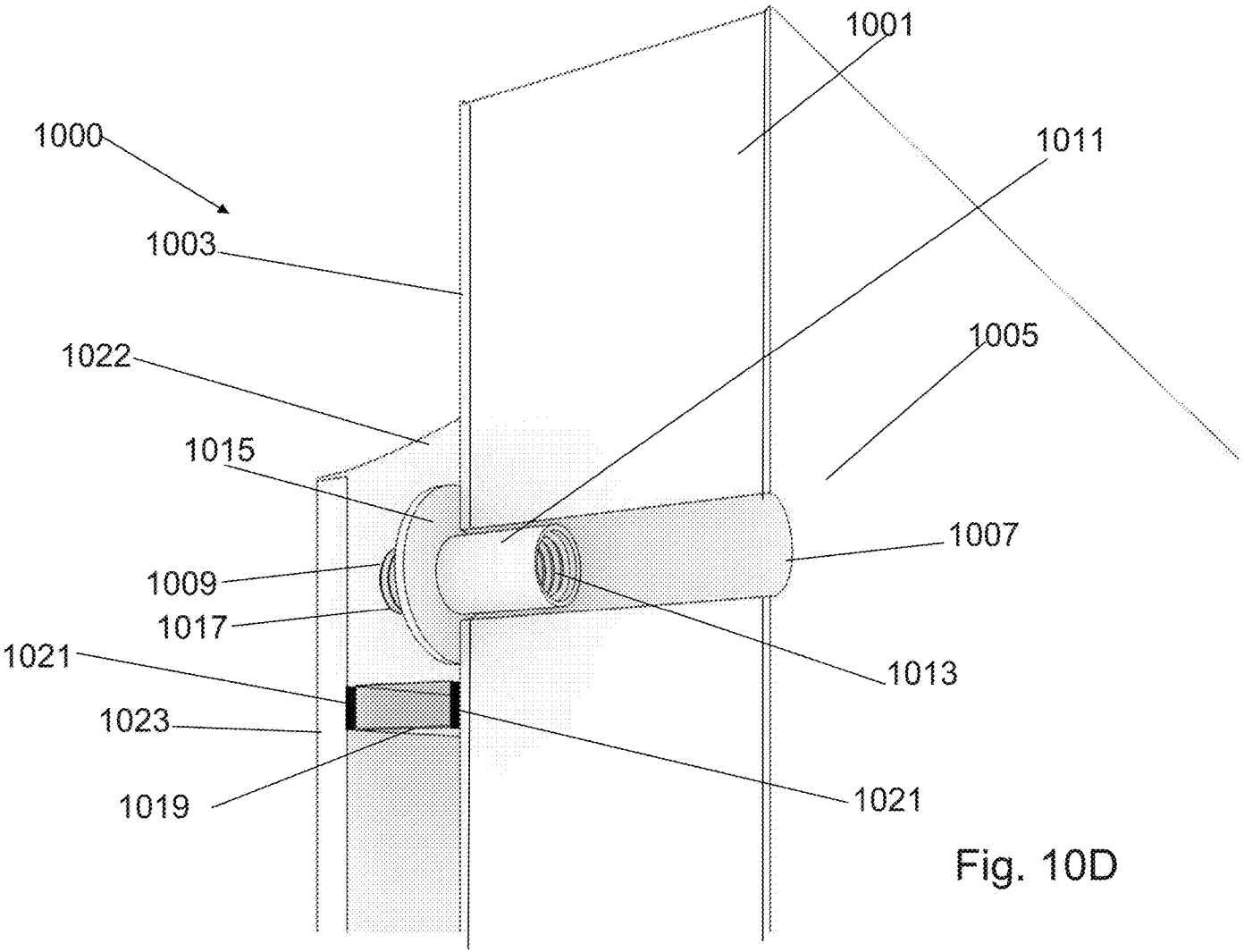

As can be seen in FIGS. 10C and 10D, a first part of a fastener 1009 can be inserted into the access hole 1007. The first part of the fastener 1009 may be a T-nut. The first part of the fastener 1009 can include a shaft 1011 extending into the access hole 1007. The access hole 1007 may have a lateral dimension large enough to allow the shaft 1011 to fit within the access hole 1007, but small enough to prevent the shaft 1011 from easily falling out of the access hole 1007 or loosely moving therein.

The first part of the fastener 1009 may have a hidden first thread 1013. The first part of the fastener 1009 may have a section 1015 with a larger lateral dimension than the radius of the shaft 1011 and larger than the radius of the access hole 1007. The section 1015 may be circular, square, rectangular, or any other shape as long as the surface area of section 1015 is large enough to resist deformation of the thin exterior metal sheet 1003 and the thin interior metal sheet 1005.

The first part of the fastener 1009 may have a section 1017 extending away from section 1015 in the direction opposite to the access hole 1007. The section 1017 may have threads for reglazing and/or supporting architectural fascia shear loads. The threaded section 1017, which is interior to adhesive 1022, may serve to resist separation of the insulated panel 1001, 1003, 1005 and exterior architectural facie panel 1023 as a result of shear forces and gravity loads. The first part of the fastener 1009 may be pressed into the access hole 1007, for example using force, such as via a rubber mallet.

A spacer 1019 can be attached to an outside surface of the thin exterior metal sheet 1003. The spacer may have a moisture vapor inhibitor 1021 on the surface of the spacer 109 which abuts the outside surface of the thin exterior metal sheet 1003. The moisture vapor inhibitor 1021 may be polyisobutylene (PIB) or any other suitable material.

Adhesive 1022 can be used to attach an exterior architectural facie panel 1023 to the spacer 1019, the outside surface of the thin exterior metal sheet 1003, and sections 1015 and 1017 of the first part of the fastener 1009. The adhesive 1022 can be silicone or any other suitable material. The adhesive 1022 may be fireproof, which protects the first part of the fastener 1009 from fire, and may help with heat loss.

The exterior architectural facie panel 1023 may be glass. When the exterior architectural facie panel 1023 is made of a material such as glass, the glass may further protect the thin exterior metal sheet 1003 from the effects of fire. When the insulated window wall substrate 1000 is connected to the exterior architectural facie panel 1023 by the adhesive 1022, the combination of the insulated window wall substrate 1000 and exterior architectural facie panel 1023 may exhibit improved structural integrity, reduced energy transfer, and improved acoustic dampening.

The spacer may also have moisture vapor inhibitor 1021 on the surface of the spacer 1019, which surface is opposite the surface of the spacer 1019 that abuts an inside surface of the exterior architectural facie panel 1023.

The exterior architectural facie panel 1023 acts as a structural diaphragm, and, when connected to insulated window wall substrate 1000, as shown in FIGS. 10C and 10D, is a structural insulated panel. The exterior architectural facie panel 1023 connected to insulated window wall substrate 1000, as shown in FIGS. 10C and 10D, may also be manufactured on an automated insulated glass line, and may be quickly and easily installed from the inside of a building.

Figure 10E:
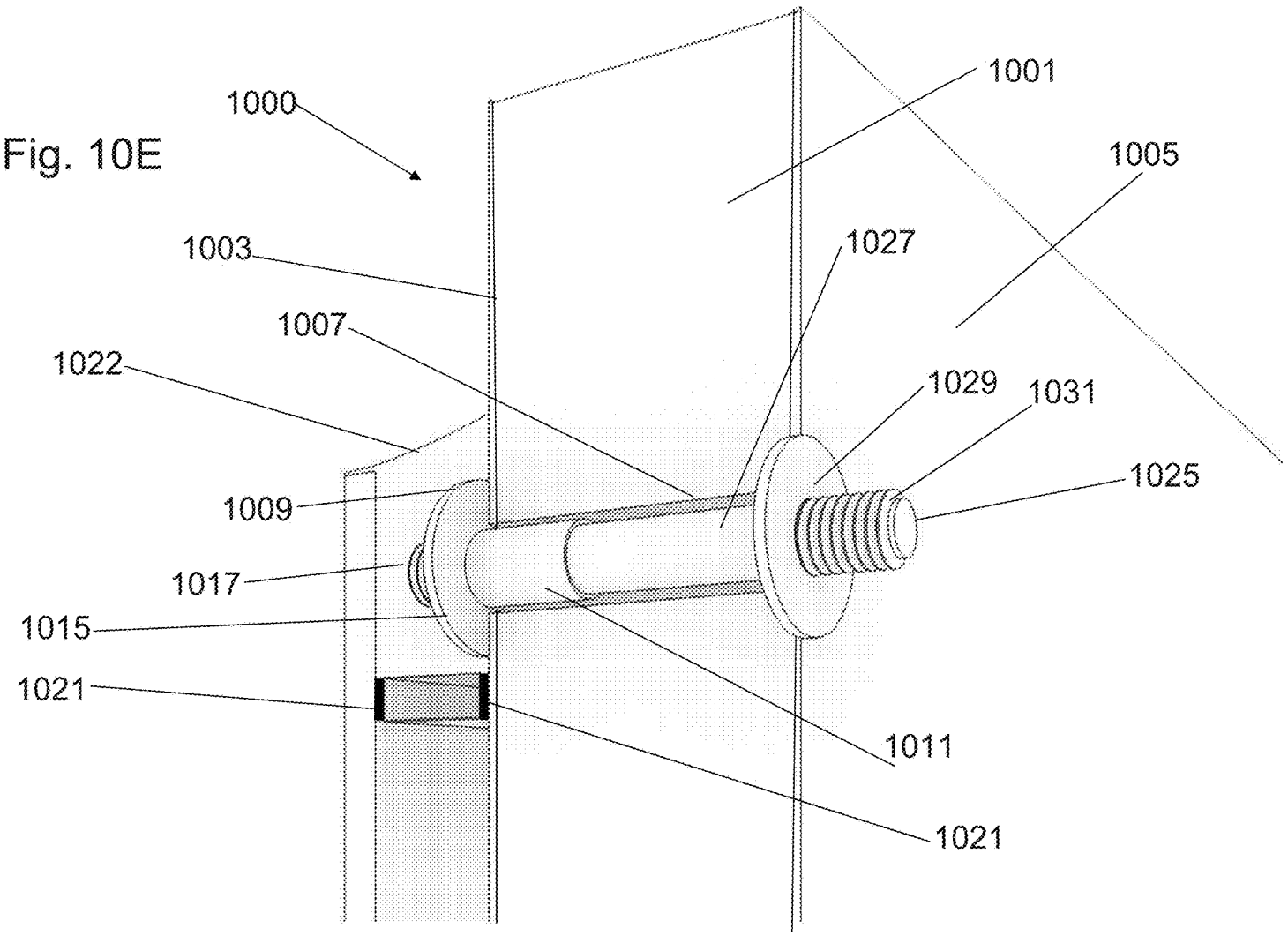

As shown in FIG. 10E, a second part of a fastener 1025 can be inserted into the access hole 1007 and a second thread of the second part of a fastener 1025 can be connected to the first thread 1013 of the first part of the fastener 1009. The shaft 1011 of the first part of the fastener 1009 can be long enough such that, when the first part 1009 and the second part 1025 of the fastener are connected, any force exerted on the connection of the first part 1009 and the second part 1025 of the fastener is not directly on the thin exterior metal sheet 1003. The shaft 1011 of the first part of the fastener 1009 can be short enough such that, when the first part 1009 and the second part 1025 of the fastener are connected, any force exerted on the connection of the first part 1009 and the second part 1025 of the fastener is not directly on the thin interior metal sheet 1005.

The second part of the fastener 1025 can have a threaded rod 1027 that has the second thread (not shown). The second part of the fastener 1025 can have a section 1029 with a larger lateral dimension than the radius of the threaded rod 1027 and larger than the radius of the access hole 1007. The second part of the fastener 1025 can have a section 1031 extending away from section 1029 in the opposite direction of the access hole 1007. The section 1031 may have threads and may be connectable to the inside of a building. The second part of the fastener 1025 may be hand tightened to the first part of the fastener 1009 to avoid damaging the insulated window wall substrate 1000.

Figure 11:
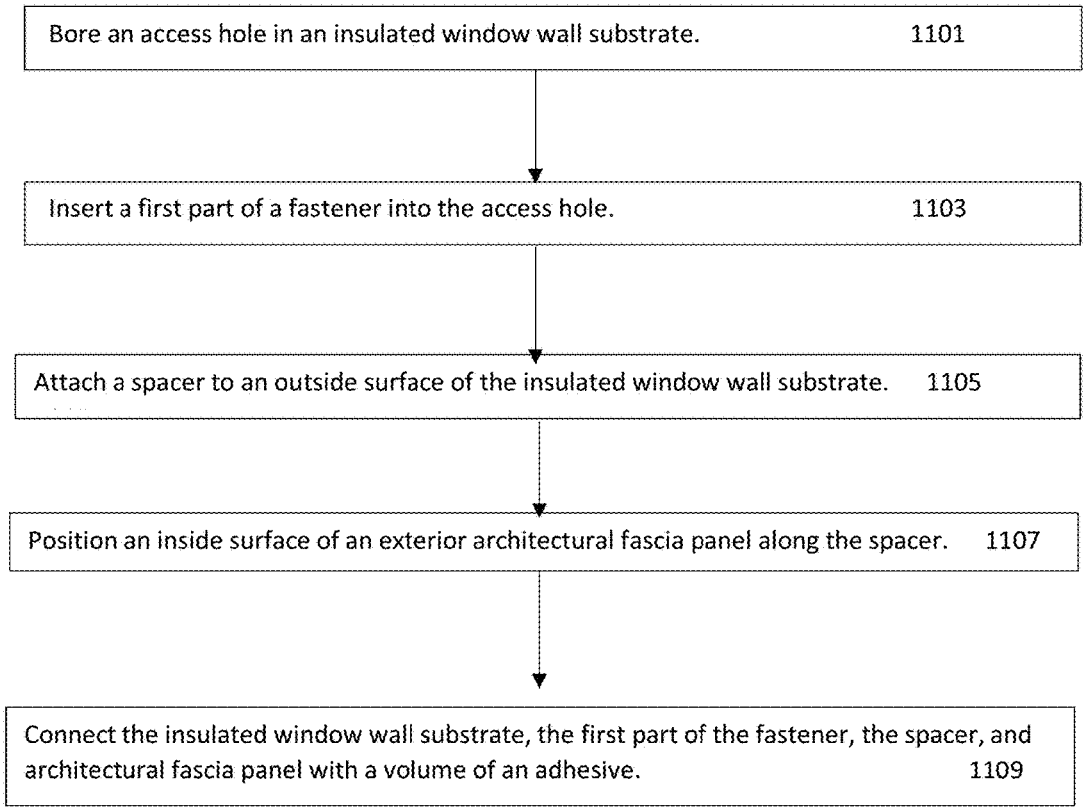
FIG. 11 is a flowchart of a method of manufacturing a structural insulated panel, according to one embodiment of the invention.

Reference is made to FIG. 11 which is a flowchart of a method of manufacturing a structural insulated panel, according to one embodiment of the invention.

In operation 1101, an access hole (e.g., the access hole 1007 from FIGS. 10A-E) can be bored through an insulated window wall substrate (e.g., the insulated window wall substrate 1000 from FIGS. 10A-E). In operation 1103, a shaft of a first part of a fastener (e.g., first part of the fastener 1009 from FIGS. 10C-E) may be inserted through the access hole. The shaft of first part of the fastener may be pressed into the access hole 1007, e.g., by hammering the first part of the fastener using a rubber mallet. In operation 1105, a spacer (e.g., the spacer 1019 from FIGS. 10C-E) can be attached to an outside surface of the insulated window wall substrate, such that a portion of the first part of a fastener extending away from the insulated window wall substrate is on the same side of the insulated window wall substrate as the spacer.

In operation 1107, an exterior architectural façade panel (e.g., the exterior architectural facie panel 1023 from FIGS. 10C-E) may be positioned along an outside surface of the spacer opposite to the surface of the spacer attached to the insulated window wall substrate. In operation 1109, the insulated window wall substrate, the first part of the fastener, the spacer, and architectural façade panel are connected to each other with a volume of an adhesive (e.g., sealant 1022 from FIGS. 10C-E).

One skilled in the art will appreciate that the present invention can be practiced by other than the described embodiments, which are presented for purposes of illustration and not limitation. In addition, different embodiments are disclosed herein, and features of certain embodiments may be combined with features of other embodiments, such that certain embodiments maybe combinations of features of multiple embodiments. Further, since numerous modifications and changes will readily occur to those skilled in the art, it is not desired to limit the invention to the exact construction and operation shown and described, and accordingly, all suitable modifications and equivalents may be resorted to, without departing from the scope or spirit of the invention as defined in the appended claims.

The invention claimed is:

1. A window wall assembly for a building, comprising:

an insulated panel comprising a layer of insulation sandwiched between a first sheet and a second sheet;

at least one hole extending through the insulated panel;

an architectural fascia panel substantially parallel to the insulated panel and proximal to the first sheet;

at least one spacer located between an outside of the insulated panel and an interior side of the architectural fascia panel, said at least one spacer creating a gap between the first sheet of the insulated panel and the architectural fascia panel;

a layer of adhesive within at least a portion of the gap between the first sheet of the insulated panel and the architectural fascia panel; and a first fastener, the first fastener comprising:

an inner section inserted into the at least one hole, an outer section extending into the gap between the first sheet of the insulated panel and the architectural fascia panel and encompassed by the layer of adhesive, and comprising at least one radially projecting structure on an outside thereof, and a flange having a lateral dimension that is greater than a radius of the at least one hole, wherein the flange is located between the inner section and the outer section and abuts an outside of the first sheet.

2. The window wall assembly of claim 1, wherein the inner section of the first fastener is hollow and comprises threading on an inside thereof, the window wall assembly further comprising:

a second fastener, the second fastener comprising:

a threaded rod extending from the second sheet of the insulated panel into the at least one hole, wherein the threaded rod comprises a first portion of threading configured to be mated with threading on the inner section of the first fastener; and a flange having a lateral dimension that is greater than the radius of the at least one hole, wherein the flange of the second fastener is configured to be secured to the threaded rod and abut an outside of the second sheet.

3. The window wall assembly of claim 2, wherein a section of the threaded rod extending through the second sheet of the insulated panel and into an interior of a building is connected to a dry-side structural reinforcement.

4. The window wall assembly of claim 1, wherein the layer of adhesive comprises nonconducting material, and the layer of adhesive is configured to bond the first sheet of the insulated panel and the architectural fascia panel.

5. The A window wall assembly for a building, comprising:

an insulated panel comprising a layer of insulation sandwiched between a first sheet and a second sheet;

at least one hole extending through the insulated panel;

an architectural fascia panel substantially parallel to the insulated panel and proximal to the first sheet;

at least one spacer located between an outside of the insulated panel and an interior side of the architectural fascia panel, said at least one spacer creating a gap between the first sheet of the insulated panel and the architectural fascia panel;

a layer of nonconducting material within at least a portion of the gap between the first sheet of the insulated panel and the architectural fascia panel;

a first fastener, the first fastener comprising:

an inner section inserted into the at least one hole, an outer section extending into the gap between the first sheet of the insulated panel and the architectural fascia panel and encompassed by the layer of nonconducting material, and comprising at least one radially projecting structure on an outside thereof, and a flange having a lateral dimension that is greater than a radius of the at least one hole, wherein the flange is located between the inner section and the outer section and abuts an outside of the first sheet;

a head receptor connected to an upper floor slab, the head receptor extending in a lengthwise direction, the head receptor comprising a top, an inner wall, and an outer wall forming an upside-down U-shape; and a sub sill connected to a lower floor slab, the sub sill extending in the lengthwise direction, the sub sill comprising a bottom, an inner wall, and an outer wall forming a U-shape;

wherein:

a top portion of the insulated panel extending above the architectural fascia panel sits within the upside-down U-shape of the head receptor, a bottom portion of the insulated panel extending below the architectural fascia panel sits within the U-shape of the sub sill, and the upside-down U-shape of the head receptor and the U-shape of the sub sill are configured to restrict movement of the insulated panel in directions transverse to the lengthwise direction.

6. The window wall assembly of claim 5, further comprising at least one primary horizontal air seal between an exterior of the building and an interior of the building, wherein the at least one primary horizontal air seal is located between a first portion of an outside of the second sheet and a portion of the inner wall of the sub sill, or between a second portion of the outside of the second sheet and a portion of the inner wall of the head receptor, or both.

7. The window wall assembly of claim 5, further comprising at least one primary vertical air seal between an exterior of the building and an interior of the building, wherein the at least one primary vertical air seal is located between the insulated panel and a second adjacent insulated panel.

8. The window wall assembly of claim 5, further comprising a starter track connected the lower floor slab, wherein:

the starter track extends along a direction substantially parallel to the lengthwise direction;

the bottom of the sub sill is connected to a first portion of a top surface of the starter track; and a dry-side structural reinforcement extends from a second portion of the top surface of the starter track or to the lower floor slab.

9. The window wall assembly of claim 5, further comprising a drain hole located in the bottom of the sub sill; and a down tube having an entrance connected to the drain hole and configured to drain water that has been collected in the sub sill.

10. The window wall assembly of claim 9, further comprising an air channel comprising:

an air entrance located at an outside of the building;

a water entrance located below the air entrance and connected to the down tube, such that water draining in the down tube can enter the air channel; and a water exit located below the air entrance at the outside of the building and configured to allow water draining in the air channel to exit to the outside of the building therethrough.

11. The window wall assembly of claim 10, wherein the air entrance is located above the drain hole in the sub sill.

12. The window wall assembly of claim 10, wherein the air entrance is located below the drain hole in the sub sill.

13. The window wall assembly of claim 5, further comprising:

an upper spandrel panel covering the upper floor slab, wherein a lower portion of the upper spandrel panel is connected to an outside of the outer wall of the head receptor, and/or a lower spandrel panel covering the lower floor slab, wherein an upper portion of the lower spandrel panel is connected to an outside of the outer wall of the sub sill.

14. A window wall assembly for a building, comprising:

an insulated panel comprising a layer of insulation sandwiched between a first sheet and a second sheet and comprising a hole extending therethrough; and a layer of nonconducting material comprising adhesive sandwiched between directly contacting a portion of an exterior side of the insulated panel and a portion of an interior side aside of an architectural fascia panel, wherein the layer of nonconducting material is configured to bond the insulated panel to the architectural fascia panel;

a spacer located between the exterior side of the insulated panel and the interior side of the architectural fascia panel;

a first fastener comprising:

an inner section inserted into the hole, an outer section extending into the layer of nonconducting material, and comprising threading on an outside thereof, and a flange having a lateral dimension that is greater than a radius of the hole, wherein the flange is located in between the inner section and the outer section of the first fastener and abuts an outside of the first sheet.

15. The window wall assembly of claim 14, further comprising a sub sill extending in a lengthwise direction, the sub sill comprising a bottom, an inner wall, and an outer wall forming a U-shape configured to accept a bottom portion of the insulated panel extending below the architectural fascia panel, said sub sill having a drain hole located in the bottom thereof; and a down tube having an entrance connected to the drain hole in the sub sill configured to drain water that has been collected in the sub sill;

wherein:

the sub sill is connected to a floor slab of the building, and the U-shape of the sub sill is configured to restrict a movement of the bottom of the insulated panel in directions transverse to lengthwise direction.

16. The window wall assembly of claim 14, wherein the inner section of the first fastener is hollow and comprises threading therein, the window wall assembly further comprising a second fastener comprising:

a threaded rod having a first portion of threading on an outside thereof and configured to be mated with the inner section of the first fastener, wherein the threaded rod extends through the hole and through the second sheet into an interior side of the insulated panel; and a flange having a lateral dimension that is greater than the radius of the hole, wherein the flange of the second fastener abuts an interior side of the second sheet.

17. The window wall assembly of claim 16, wherein a dry-side structural reinforcement has a plurality of holes that are substantially perpendicular to the insulated panel, wherein the plurality of holes are configured to allow air to flow through the dry-side structural reinforcement in a direction substantially parallel to the insulated panel.

18. The window wall assembly of claim 15, further comprising an air channel having:

an air entrance located at an outside of the building, a water entrance located below the air entrance and connected to an exit of the down tube, such that water draining in the down tube can enter the air channel; and an exit of the air channel located below the water entrance and at an outside of the building.

19. The window wall assembly of claim 18, wherein the air channel has at least one of:

an air guide attached to the air entrance of the air channel, the air guide being angled to guide air from the outside of the building into the air entrance; and an air deflector attached to the exit of the air channel, the air deflector being angled to inhibit a flow of air from the outside of the building into the exit of the air channel.

20. The window wall assembly of claim 15, wherein the outer wall of the sub sill has at least one opening to an outside of the building.

21. The window wall assembly of claim 14, further comprising:

the architectural fascia panel substantially parallel to the insulated panel;

a head receptor connected to an upper floor slab, the head receptor extending in a lengthwise direction, the head receptor comprising a top, an inner wall, and an outer wall forming an upside-down U-shape; and a sub sill connected to a lower floor slab, the sub sill extending in the lengthwise direction, the sub sill comprising a bottom, an inner wall, and an outer wall forming a U-shape;

wherein:

a top portion of the insulated panel extending above the architectural fascia panel sits within the upside-down U-shape of the head receptor, a bottom portion of the insulated panel extending below the architectural fascia panel sits within the U-shape of the sub sill, and the upside-down U-shape of the head receptor and the U-shape of the sub sill are configured to restrict movement of the insulated panel in directions transverse to the lengthwise direction.

22. The window wall assembly of claim 21, further comprising:

an upper spandrel panel covering the upper floor slab, wherein a lower portion of the upper spandrel panel is connected to an outside of the outer wall of the head receptor, and/or a lower spandrel panel covering the lower floor slab, wherein an upper portion of the lower spandrel panel is connected to an outside of the outer wall of the sub sill.

23. The window wall assembly of claim 15, wherein the entrance of the down tube is connected below the drain hole in the sub sill.

24. The window wall assembly of claim 14, wherein the flange of the first fastener is integral to the inner section and the outer section of the first fastener.

* * * * *